US010705467B2

(12) United States Patent
Arai

(10) Patent No.: US 10,705,467 B2
(45) Date of Patent: Jul. 7, 2020

(54) IMAGE FORMING APPARATUS CAPABLE OF EVALUATING THE CONSUMPTION OF A FIXING BELT, CONTROL METHOD AND CONTROL PROGRAM THEREOF

(71) Applicant: Konica Minolta Inc., Tokyo (JP)

(72) Inventor: Junichi Arai, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/274,949

(22) Filed: Feb. 13, 2019

(65) Prior Publication Data

US 2019/0286040 A1 Sep. 19, 2019

(30) Foreign Application Priority Data

Mar. 16, 2018 (JP) ..... 2018-049824

(51) Int. Cl.
*G03G 15/00* (2006.01)
*G03G 15/20* (2006.01)

(52) U.S. Cl.
CPC ..... *G03G 15/556* (2013.01); *G03G 15/2053* (2013.01); *G03G 15/553* (2013.01); *G03G 2215/2038* (2013.01)

(58) Field of Classification Search
None
See application file for complete search history.

(56) References Cited

U.S. PATENT DOCUMENTS 6,768,879 B2 * 7/2004 Kosuge ..... G03G 15/081 399/296
2017/0212458 A1 * 7/2017 Yasui ..... G03G 15/2053

FOREIGN PATENT DOCUMENTS

| | | | |
|---|---|---|---|
| JP | 2011128305 | A | 6/2011 |
| JP | 2012053332 | A | 3/2012 |
| JP | 2016090830 | A | 5/2016 |
| JP | 2016126132 | A | 7/2016 |

OTHER PUBLICATIONS

JP_2012053332_A_T MachineTranslation, Japan, Mar. 2012, Higa.*

* cited by examiner

*Primary Examiner* — Victor Verbitsky
(74) *Attorney, Agent, or Firm* — Rankin, Hill & Clark LLP

(57) ABSTRACT

An image forming apparatus includes a fixer that fixes toner adhering to a sheet that passes through a fixing nip, the fixer including: an endless fixing belt that rotates; and a presser that presses the fixing belt to form the fixing nip between the fixing belt and the presser. The image forming apparatus includes a hardware processor that calculates an amount of the toner adhering to the sheet that passes through the fixing nip, and determines a degree of abrasion of the fixing belt, based on the amount of the toner calculated by the hardware processor.

26 Claims, 17 Drawing Sheets

FIG. 8

| REGIONS IN CD DIRECTION OF SURFACE OF BELT | REGION RG1 | REGION RG2 | REGION RG3 | REGION RG4 | REGION RG5 |
|---|---|---|---|---|---|
| DEGREE OF ABRASION CALCULATED FROM ADHESION AMOUNT OF TONER (%) | 10 | 20 | 30 | 20 | 5 |

FIG. 9

| ADHESION AMOUNT OF TONER | LARGE | MODERATE | SMALL | ABSENCE |
|---|---|---|---|---|
| ADDITIONAL VALUE TO DEGREE OF ABRASION ($\times 10^{-3}$%/SHEET) | 3 | 5 | 10 | 1 |

FIG. 12
| TEMPERATURE / MATERIAL OF TONER | HIGH | STANDARD | LOW |
|---|---|---|---|
| TONER TA | ×1.1 | ×1.2 | ×1.1 |
| TONER TB | ×1 | ×1.1 | ×0.9 |
| TONER TC | ×1 | ×1.1 | ×0.7 |
FIG. 13A
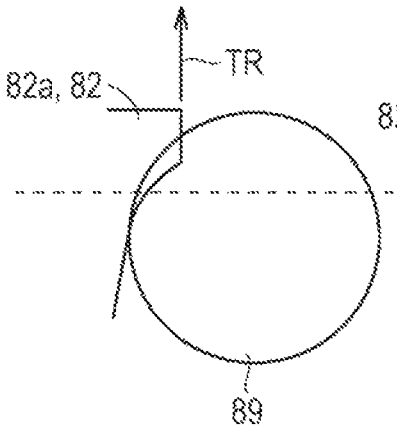
FIG. 13B
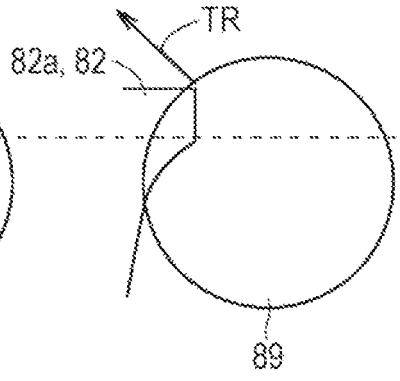
FIG. 13C
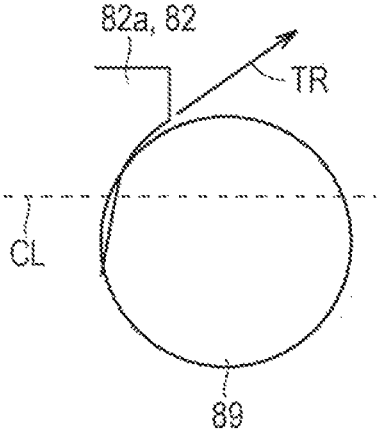

FIG. 15

| REGIONS IN CD DIRECTION OF SURFACE OF BELT | REGION RG1 | REGION RG2 | REGION RG3 | REGION RG4 | REGION RG5 |
|---|---|---|---|---|---|
| DEGREE OF ABRASION CALCULATED FROM PASSING POSITIONS OF EDGES (%) | 15 | 20 | 0 | 20 | 15 |

FIG. 16

| TYPE OF SHEET | THIN PAPER | PLAIN PAPER | THICK PAPER |
|---|---|---|---|
| ADDITIONAL VALUE TO DEGREE OF ABRASION ($\times 10^{-3}$%/SHEET) | 1 | 2 | 3 |

FIG. 19

70

| | |
|---|---|
| DEGREE OF ABRASION OF LEFT END OF BELT | 90% |
| DEGREE OF ABRASION OF CENTER OF BELT | 30% |
| DEGREE OF ABRASION OF RIGHT END OF BELT | 50% |
| DEGREE OF ABRASION DUE TO EDGES OF SHEET | 80% |
| PRINTABLE NUMBER OF SHEETS UNTIL LIFE ARRIVAL OF FIXING BELT | APPROXIMATELY 1000 SHEETS |

NOW CLOSE TO TIME FOR REPLACEMENT OF FIXING BELT

IMAGE FORMING APPARATUS CAPABLE OF EVALUATING THE CONSUMPTION OF A FIXING BELT, CONTROL METHOD AND CONTROL PROGRAM THEREOF

The entire disclosure of Japanese patent Application No. 2018-049824, filed on Mar. 16, 2018, is incorporated herein by reference in its entirety.

BACKGROUND

Technological Field

The present invention relates to an image forming apparatus, a control method of the image forming apparatus, and a control program of the image forming apparatus. More specifically, the present invention relates to an image forming apparatus capable of evaluating the consumption of a fixing belt accurately, a control method of the image forming apparatus, and a control program of the image forming apparatus.

Description of the Related Art

Examples of an electrophotographic image forming apparatus include: a multi function peripheral (MFP) having a scanner function, a facsimile function, a copier function, a printer function, a data-communication function, and a server function, a facsimile, a copier, and a printer.

For a general type of image forming apparatus, a developer develops an electrostatic latent image formed on an image bearer, to form a toner image. After a transfer of the toner image to a recording medium, a fixer fixes the toner image to a sheet, resulting in formation of an image on the recording medium. For another type of usage forming apparatus, a developer develops an electrostatic latent image formed on an image bearer, to form a toner image. The toner image is transferred to an intermediate transfer belt with a primary transfer roller. The toner image on the intermediate transfer belt is secondary-transferred to a recoding medium with a secondary transfer roller.

One type of fixer includes: an endless fixing belt that rotates; and a presser that presses the fixing belt to form a fixing nip between the fixing belt and the presser. For this type of fixer, it is known that, when a sheet passes through the fixing nip, an edge of the sheet present in the direction orthogonal to the conveyance direction of the sheet, causes shearing force to the fixing belt, resulting in abrasion of the surface of the fixing belt.

Thus, for example, JP 2012-53332 A or JP 2016-090830 A discloses a technique of evaluating the consumption of a fixing belt due to shearing force, on the basis of the passing position of an edge of a sheet. JP 2012-53332 A discloses a technique of performing, in response to a print request, abrasion prediction, on the basis of information regarding a recording medium to pass, on regions through which both ends of the recording medium are to pass, in the width direction of a fixing member at the current travelling position of the fixing member and adjusting the travelling position in the axial direction of a roller of the fixing member, on the basis of a result of the abrasion prediction.

JP 2016-090830 A discloses an image forming apparatus including: a fixer that causes a recoding material on which an image is formed by an image former, to pass through a fixing nip portion to fix the image; a temperature detector that detects the temperature of the fixer; a measurer that measures the time of passage of the recording material through the fixer, on the basis of size; and a controller that determines the life of the fixer, on the basis of the temperature detected by the temperature detector and the time measured by the measurer.

Note that techniques regarding conventional image forming apparatuses are disclosed in JP 2016-126132 A and JP 2011-128305 A. JP 2016-426132 A discloses a technique of performing, in a case where it is detected that any of a plurality of process cartridges has not arrived at a predetermined life, a first toner supply mode in which forming a toner image on an intermediate transfer body allows supply of toner to a cleaning blade, and performing, in a case where it is detected that all the plurality of process cartridges has arrived at the predetermined life, a second toner supply mode in which forming a toner image higher in depth than the toner image formed on the intermediate transfer body in the first toner supply mode, on the intermediate transfer body allows supply of toner to the cleaning blade.

JP 2011-428305 A discloses an image forming apparatus including: an image former that performs image forming on the basis of image information; and a controller that controls the image former, in which the image former includes: an image bearer that bears an image developed by a developing agent containing lubricant and transfers the image to a different thing; and a plurality of cleaning portions that cleans the developing agent remaining on the image bearer after the transfer. The controller performs switching in use between the cleaning portions, in accordance with an image printing rate in the image information.

In recent years, a phenomenon in which sliding occurs between a sheet and the surface of a fixing belt and the fixing belt is consumed by frictional force due to the occurrence of the sliding, has been found. The consumption of the fixing belt by the frictional force due to the sliding progresses faster than the consumption of a fixing belt due to shearing force. Thus, it is difficult to evaluate the consumption of a fixing belt accurately on the basis of shearing force that occurs in the fixing belt.

SUMMARY

The present invention has been made in order to solve the problem, and an object of the present invention is to provide an image forming apparatus capable of evaluating the consumption of a fixing belt accurately, a control method of the image forming apparatus, and a control program of the image forming apparatus.

To achieve the above mentioned object, according to an aspect of the present invention, there is provided an image forming apparatus including a fixer that fixes toner adhering to a sheet that passes through a fixing nip, the fixer including: an endless fixing belt that rotates; and a presser that presses the fixing belt to form the fixing nip between the fixing belt and the presser, and the image forming apparatus reflecting one aspect of the present invention comprises a hardware processor that calculates an amount of the toner adhering to the sheet that passes through the fixing nip, and determines a degree of abrasion of the fixing belt, based on the amount of the toner calculated by the hardware processor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 schematically illustrates a first abrasion-level table stored in an HDD in the embodiment of the present invention;

FIG. 9 schematically illustrates a first additional-value table stored in the HDD in the embodiment of the present invention;

FIG. 12 schematically illustrates an additional-value correction table stored in the HDD, in the embodiment of the present invention;

FIGS. 13A to 13C schematically illustrate variations in the positional relationship between a protrusion of a pressure pad and a pressing roller;

FIG. 15 schematically illustrates a second abrasion-level table stored in the HDD in the embodiment of the present invention;

FIG. 16 schematically illustrates a second additional-value table stored in the HDD in the embodiment of the present invention;

FIG. 19 schematically illustrates a screen to be displayed on an operation panel in the embodiment of the present invention;

DETAILED DESCRIPTION OF EMBODIMENTS

Hereinafter, one or more embodiments of the present invention will be described with reference to the drawings. However, the scope of the invention is not limited to the disclosed embodiments.

A case where an image forming apparatus is an MFP, will be described in the following embodiment. The image forming apparatus may be a facsimile, a copier, or a printer, instead of the MFP.

[Configuration of Image Forming Apparatus]

Figure 1:
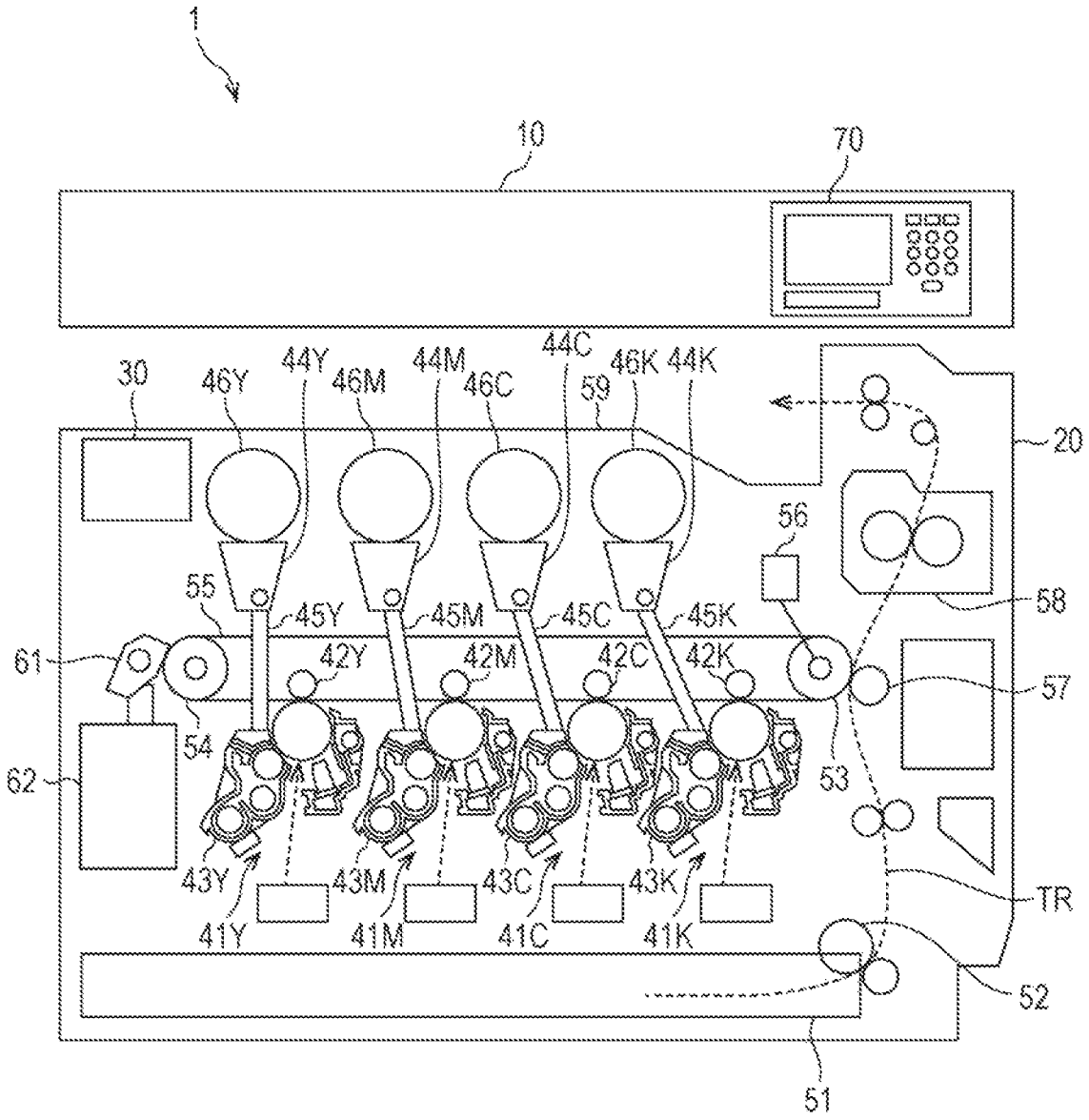
FIG. 1 is a schematic sectional view of the configuration of an image forming apparatus according to an embodiment of the present invention.

FIG. 1 is a schematic sectional view of the configuration of an image forming apparatus 1 according to the embodiment of the present invention.

With reference to FIG. 1, the image forming apparatus 1 according to the present embodiment that is an MFP, includes an image reader 10, a printer 20, a controller 30, and an operation panel 70 (exemplary setting receiver). The image reader 10 mainly reads an original image, and the printer 20 prints a read image. The controller 30 controls the operation of the image forming apparatus 1.

The image reader 10 moves a scanner to read an original mounted on an original glass plate (not illustrated). The image reader 10 resolves an image of the read original into three colors of red (R), green (G), and blue (B). A charge coupled device (CCD) image sensor (not illustrated) in the image reader 10 converts the resolved image in the three colors, into an electric signal, resulting in generation of RGB image data. After performing various types of processing to the image data for the colors generated by the image reader 10, the controller 30 converts the image data for the colors into image data for reproduction colors of cyan (C), magenta (M), yellow (Y), and black (K), and stores the image data for the reproduction colors after the conversion, into an image memory inside the controller 30.

The printer 20 includes: image creators 41Y, 41M, 41C, and 41K (hereinafter, also collectively referred to as image creators 41); primary transfer rollers 42Y, 42M, 42C, and 42K; sub-hoppers 44Y, 44M, 44C, and 44K (hereinafter, also collectively referred to as sub-hoppers 44); joints 45Y, 45M, 45C, and 45K; toner bottles 46Y, 46M, 46C, and 46K (hereinafter, also collectively referred to as toner bottles 46); a sheet feeding tray 51; a sheet feeding roller 52; a driving roller 53; a driven roller 54; an intermediate transfer belt 55; a transfer motor 56; a secondary transfer roller 57; a fixer 58; a sheet discharge tray 59; a transfer-belt cleaner 61; and a waste-toner box 62.

After performing correction for positional discrepancy to the image data stored in the image memory, the controller 30 reads the image data every scanning line from the image memory in synchronization with supply of a sheet, and transmits the image data as a driving signal to a light emitting diode that is an exposer of each image creator 41.

The controller 30 extracts sheets one by one from the sheet feeding tray 51 with the sheet feeding roller 52, and conveys each sheet with the timing of the intermediate transfer belt 55.

The intermediate transfer belt 55 is stretched between the driving roller 53 and the driven roller 54. A resin material, such as polycarbonate, polyimide, or polyamide-imide, is used for the intermediate transfer belt 55. The driven roller 54 is biased to the left of FIG. 1 by a spring (not illustrated). This arrangement keeps the intermediate transfer belt 55 being given tension. The controller 30 causes the transfer motor 56 to rotate the driving roller 53 counterclockwise.

The image creators 41 for yellow (Y), magenta (M), cyan (C), and black (K) in color are disposed at predetermined intervals below the intermediate transfer belt 55. The primary transfer rollers 42Y, 42M, 42C, and 42K are disposed at positions opposed to respective photoconductors of the image creators 41 through the intermediate transfer belt 55. The outer circumference of a photoconductor drum of each image creator 41, is provided with a charger, the exposer, a developer, and a cleaner.

After causing each charger to charge the surface of the photoconductor, the controller 30 causes each exposer to form an electrostatic latent image in accordance with the image data, and causes each developer to cause toner to adhere to the electrostatic latent image, resulting in formation of a toner image on the surface of the photoconductor. When a predetermined position of the intermediate transfer belt 55 passes between the photoconductors of the image creators 41 for the colors and the primary transfer rollers 42Y, 42M, 42C, and 42K, the controller 30 primary-transfers the toner image onto the intermediate transfer belt 55.

When a sheet extracted from the sheet feeding tray 51 passes through the nip portion between the intermediate transfer belt 55 and the secondary transfer roller 57 through a conveyance path TR, the controller 30 secondary-transfers the toner image on the intermediate transfer belt 55, onto the sheet with the secondary transfer roller 57. The controller 30 conveys the secondary-transferred sheet to the fixer 58, and causes the fixer 58 to fix the toner image on the sheet by heating and pressing. The controller 30 discharges the sheet on which the toner image is fixed, to the sheet discharge tray 59.

The controller 30 removes the toner remaining on the surface of each photoconductor with the cleaner, and collects the toner remaining on the intermediate transfer belt 55 with the transfer-belt cleaner 61, resulting in storage in the waste-toner box 62.

The respective developers 43Y, 43M, 43C, and 43K of the image creators 41 (hereinafter, also collectively referred to as the developers 43) each are provided with the sub-hopper 44 that replenishes a certain amount of toner for the color. The developers 43 are supplied with the toner from the sub-hoppers 44 through the respective joints 45Y, 45M, 45C, and 45K. The toner bottles 46 each are detachably provided above the sub-hopper 44.

When the amount of remaining toner is small in a sub-hopper 44, the toner bottle 46 supplies toner to the sub-hopper 44. When no toner is left in the toner bottle 46, the toner bottle 46 is replaced with a new toner bottle 46.

Figure 2:
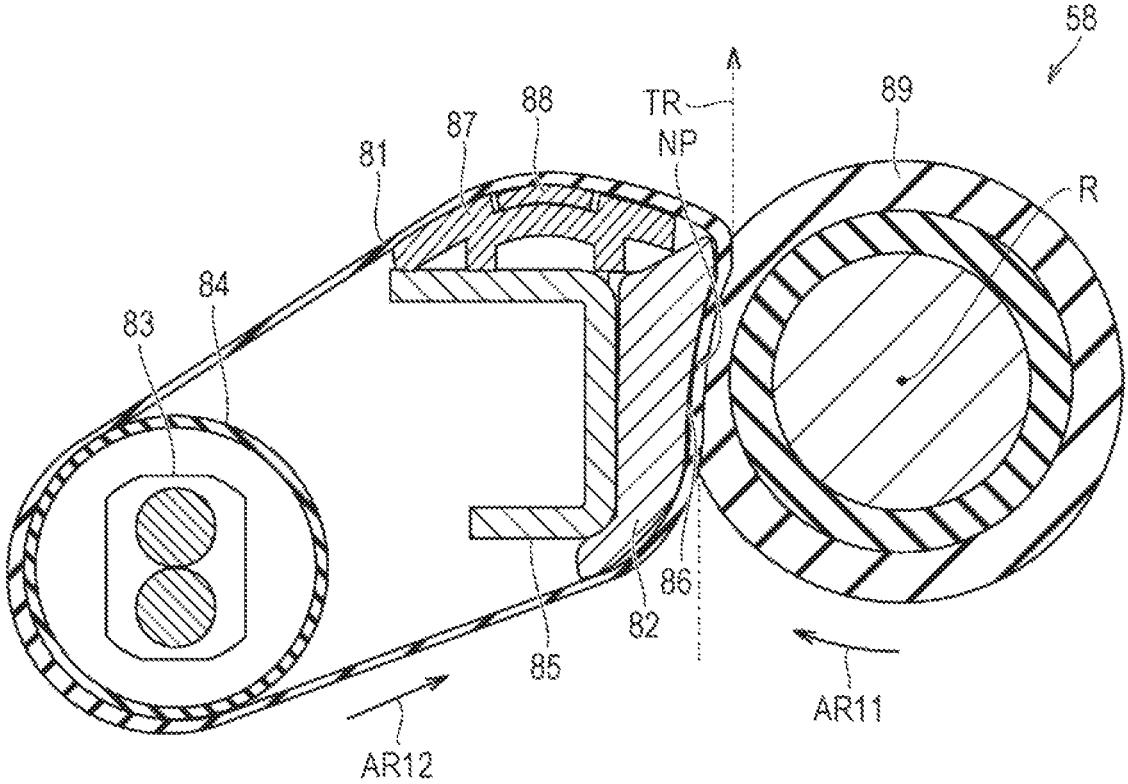
FIG. 2 is a schematic sectional view of the configuration of a fixer according to the embodiment of the present invention.

FIG. 2 is a schematic sectional view of the configuration of the fixer 58 according to the embodiment of the present invention.

With reference to FIG. 2, the fixer 58 adopting a method of supporting a fixing belt 81 biaxially, includes the fixing belt 81, a pressure pad 82, a heater 83, a heating roller 84, a pad frame 85, a slider 86, a guider 87, a collector/re-coater 88, and a pressing roller 89 (exemplary presser). The fixer 58 fixes toner (toner image) adhering to a sheet that passes through a fixing nip NP. The sheet to which the toner image is transferred, is conveyed to the fixing nip NP with the surface on which the toner image is transferred, facing the fixing belt 81 heated, and then the sheet passes through the fixing nip NP. The sheet that passes through the fixing nip NP is pushed and heated by the fixing belt 81. This arrangement allows the toner image to be fixed to the sheet.

The fixing belt 81 is an endless belt. Both ends in the axial direction of the fixing belt 81 are sandwiched between eiders (side plates) not illustrated, so that the fixing belt 81 pressing against the pressing roller 89 is supported at a position at which the fixing nip NP is formed. The fixing belt 81 is stretched by the pressure pad 82 and the heating roller 84. The fixing belt 81 is given tension by a biaser (not illustrated).

The fixing belt 81 includes a base layer, an elastic layer formed outside the base layer, and a release layer formed outside the elastic layer. Preferably, the fixing belt 81 having an arbitrary outer diameter, has an outer diameter of 10 to 100 mm, for example. The base layer including polyimide, stainless steel (SUS), or nickel (Ni) formed by electroforming, has a thickness of 5 to 100 μm, for example. The elastic layer including a high heat-resistant material, such as silicone rubber or fluoro-rubber, has a thickness of 10 to 300 μm, for example. The release layer including a material, such as a fluoro-tube or a fluorine-based coating, giving releasability to the fixing belt 81, has a thickness of 5 to 100 nm, for example.

The pressure pad 82 is disposed inside the fixing belt 81. The pressure pad 82 extends parallel to the extending direction of the central axis R of the pressing roller 89. The pressure pad 82 pushes the fixing belt 81 from the inside of the fixing belt 81, resulting in formation of the fixing nip NP between the fixing belt 81 and the pressing roller 89. The pressure pad 82 guides rotation of the fixing belt 81.

The pressure pad 82 including resin, such as polyphenylene sulfide, polyimide, or a liquid crystal polymer, metal, such as aluminum or iron, or ceramic, has an arbitrary shape. The pressure pad 82 may include the material and a securer including silicone rubber or fluoro-rubber.

The heater 83 is provided inside the heating roller 84. The heater 83 extends parallel to the extending direction of the central axis R of the pressing roller 89. The heater 83 heats the fixing belt 81 to a predetermined target temperature through the heating roller 84. For example, a halogen heater is used for the heater 83.

As a method of heating the fixing belt 81, in addition to a method with the halogen heater described above, there may be provided a method of heating the fixing belt 81 and the heating roller 84 by induction heating (IH) or a method of causing the fixing belt 81 and the heating roller 84 that serve as a resistance heating element, to generate heat.

The heating roller 84 having a cylindrical shape, is provided inside the fixing belt 81. The heating roller 84 is driven by rotation of the fixing belt 81 while heating the fixing belt 81.

The heating roller 84 includes metal, such as aluminum or SUS. Preferably, the heating roller 84 having an arbitrary outer diameter, has an outer diameter of 10 to 100 mm, for example. Preferably, the heating roller 84 has a thickness of 0.1 to 5 mm, for example. In a case where the heater 83 includes a halogen heater, preferably, the inner surface of the heating roller 84 is black in color. In order to prevent an event in which the outer surface of the heating roller 84 is damaged, for example, by foreign substances, the outer surface of the heating roller 84 may be subjected to processing such as polytetrafluoroethylene (PTFE) coating.

The pad frame 85 is provided inside the fixing belt 81. The pad frame 85 extends parallel to the extending direction of the central axis R of the pressing roller 89. The pad frame 85 supports the pressure pad 82.

The slider 86 is disposed between the fixing belt 81 and the pressure pad 82. Generally, the slider 86 includes glass cloth as a base material and has a sliding face covered with a fluorine-based resin. Other than the configuration, the slider 86 may include a fabric of fluorine fiber, a sheet of fluoro-resin, or a glass coat. Provision of the slider 86 enables a reduction in the resistance in sliding between the fixing belt 81 and the pressure pad 82 and stabilization of rotation of the fixing belt 81.

Here, when sliding continues between the fixing belt 81 and the slider 86, abrasion occurs between the fixing belt 81 and the slider 86, so that the resistance in sliding is more likely to increase. Increase of the resistance in sliding causes trouble in rotation of the fixing belt 81. Thus, preferably, lubricant is coated between the fixing belt 81 and the slider 86. This arrangement enables inhibition of abrasion between the fixing belt 81 and the slider 86, so that the fixing belt 81 and the slider 86 can improve in durability. The lubricant includes, preferably, a high heat-resistant silicon-based lubricant or a high heat-resistant fluorine-based lubricant, more preferably, fluoro-grease. Because fluoro-grease has high viscosity and includes a solid component, use of fluoro-grease allows the lubricant to remain easily inside the fixing nip NP, so that an effect of inhibiting abrasion can be retained in comparison to use of oil. In order to retain the lubricant inside the fixing nip NP, preferably, the slider 86 has asperity. Although the asperity of the slider 86 is arbitrary in size, preferably, the slider 86 has a surface roughness Ra of 1 to 50 μm in terms of a function of retaining the lubricant and inhibition of image ununiformity due to the asperity.

The guider 87 is secured at the upper portion of the pad frame 85. The guider 87 guides the fixing belt 81 at a position on the downstream side in the rotating direction of the fixing belt 81 with respect to the fixing nip NP.

The collector/re-coater 88 is disposed at a position on the downstream side in the rotating direction of the fixing belt 81 with respect to the fixing nip NP inside the fixing belt 81. The collector/re-coater 88 collects superfluous lubricant coated on the inner circumferential face of the fixing belt 81, and recoats the inner circumferential face of the fixing belt 81 with the collected lubricant. This arrangement can avoid an event in which extrusion of the lubricant coated on the inner circumferential face of the fixing belt 81 from an end in the longitudinal direction of the fixing belt 81, due to the pressure of the fixing nip NP, reduces the amount of the lubricant.

Preferably, the collector/re-coater 88 is secured to the guider 87 so as to be in contact with the inner circumferential face of the fixing belt 81, stably. Particularly, in a case where the collector/re-coater 88 protrudes from the guider 87, preferably, the collector/re-coater 88 is disposed at a substantially central position along the rotating direction of the fixing belt 81 in the guider 87. This arrangement enables the collector/re-coater 88 in contact with the inner circumferential face of the fixing belt 81, stably. Because requiring a function of retaining the lubricant, preferably, the collector/re-coater 88 includes a high heat-resistant fibrous material, such as aramid fiber or fluorine fiber, or a high heat-resistant porous material, such as silicon sponge.

The pressing roller 89 is disposed at a position opposed to the pressure pad 82 through the fixing belt 81, outside the fixing belt 81. The pressing roller 89 presses a position opposed to the pressure pad 82, of the fixing belt 81 from the outside of the fixing belt 81, to form the fixing nip NP between the fixing belt 81 and the pressing roller 89. A fixing conveyance motor (not illustrated) drives the pressing roller 89 to rotate in the direction indicated with an arrow AR11 at a predetermined speed in rotation. The fixing belt 81 rotates in the direction indicated with an arrow AR12 in accordance with the rotation of the pressing roller 89.

The outer circumferential face of the pressing roller 89 includes a material, such as rubber, softer than the pressure pad 82. Thus, with the pressing roller 89 pressing against the fixing belt 81, the outer circumferential face of the pressing roller 89 deforms along the shape of the pressure pad 82, and the pressure pad 82 deforms hardly.

The pressing roller 89 includes a cored bar, an elastic layer formed outside the cored bar, and a release layer formed outside the elastic layer. Preferably, the pressing roller 89 having an arbitrary outer diameter, has an outer diameter of 20 to 100 mm, for example. The cored bar includes metal, such as aluminum or iron. The cored bar that is pipe-shaped, has a thickness of 0.1 to 10 mm. The cored bar may have a solid shape or a three-arrows sectional shape. The elastic layer including a high heat-resistant material, such as silicone rubber or fluoro-rubber, has a thickness of 1 to 20 mm, for example. The release layer including a material, such as a fluoro-tube or a fluorine-based coating, giving releasability to the pressing roller 89, has a thickness of 5 to 100 μm, for example.

Figure 3:
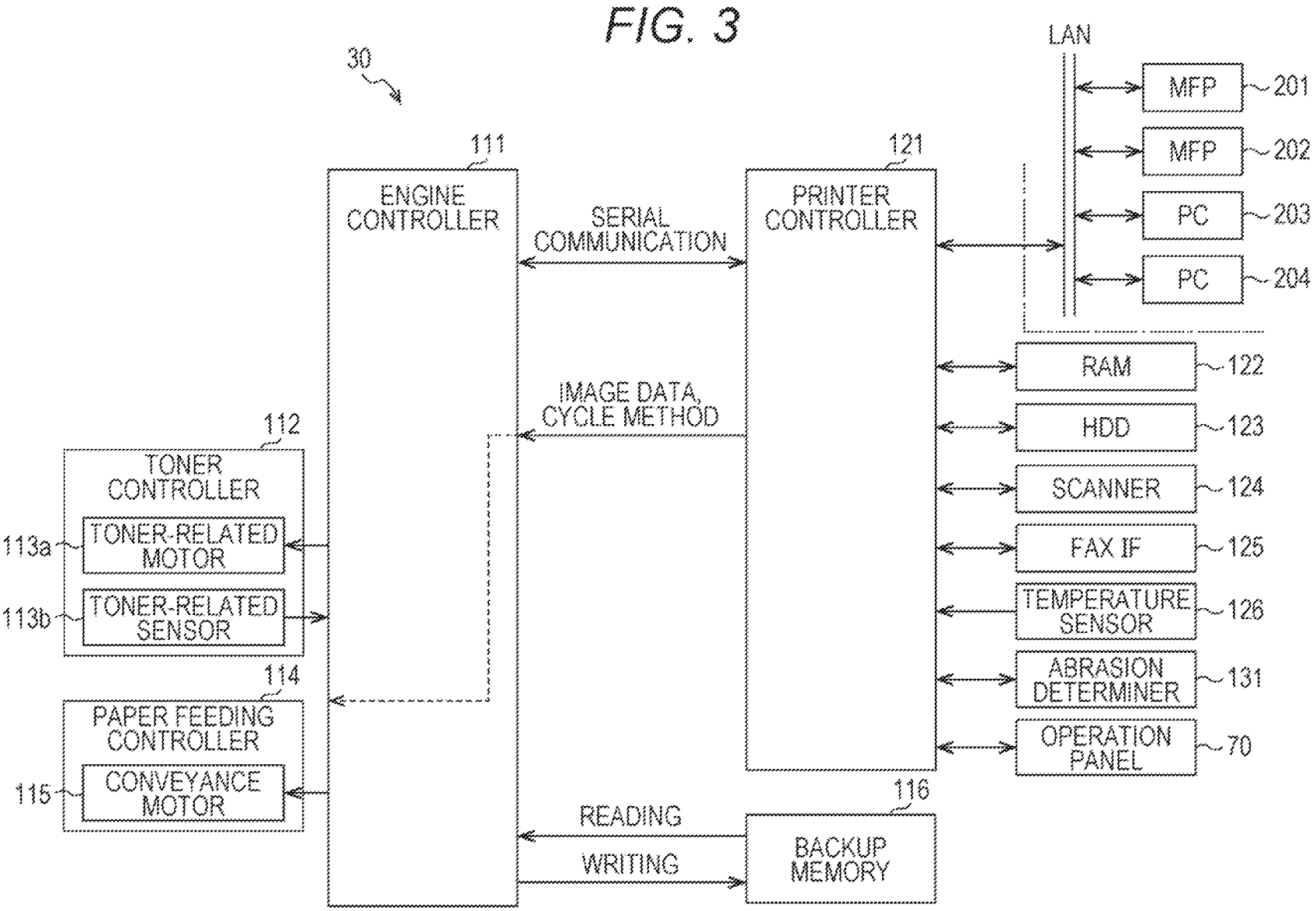
FIG. 3 is a block diagram of the control configuration of the image forming apparatus according to the embodiment of the present invention.

FIG. 3 is a block diagram of the control configuration of the image forming apparatus 1 according to the embodiment of the present invention.

With reference to FIG. 3, the controller 30 includes an engine controller 111, a printer controller 121, and an abrasion determiner 131 (exemplary calculator, determiner, life determiner, transferer, temperature setter, predictor, toner image former, and transmitter). The engine controller 111 controls a toner controller 112 and a paper feeding controller 114. The engine controller 111 writes data requiring backup into a backup memory 116, and reads data stored in the backup memory 116 as necessary.

The toner controller 112 including a toner-related motor 113*a*, controls a driving source for toner replenishment from the toner bottles 46 to the sub-hoppers 44 and a driving source for toner replenishment from the sub-hoppers 44 to the developers 43. The toner controller 112 further includes a toner-related sensor 113*b* that detects reductions in the toner in the sub-hoppers 44. The toner-related sensor 113*b* is connected to the engine controller 111.

The paper feeding controller 114 including a conveyance motor 115, controls the conveyance motor 115, such as starting and stopping of the conveyance motor 115 and monitoring of the conveyance motor 115 rotating.

The printer controller 121 controls each of a random access memory (RAM) 122, a hard disk drive (HDD) 123, the scanner 124, a facsimile interface 125, and the operation panel 70. The printer controller 121 is capable of performing serial communication with the engine controller 111. The printer controller 121 provides the engine controller 111 with image data through an image bus. The printer controller 121 exchanges data with each of MFPs 201 and 202 and PCs 203 and 204 through a LAN. The printer controller 121 performs mutual communication with the abrasion determiner 131. Furthermore, the printer controller 121 counts the cumulative number of printed sheets and stores the cumulative number of printed sheets into the HDD 123.

The RAM 122 and the HDD 123 each are a storage medium. The RAM 122 is superior to the HDD 123 in terms of transfer speed. Although the HDD 123 is inferior to the RAM 122 in terms of transfer speed, the HDD 123 is superior to the RAM 122 in terms of storage capacity. The HDD 123 serving as an image memory, stores image data, the HDD 123 storing various types of information, such as a control program.

The scanner 124 reads an original to generate image data.

The facsimile interface 125 performs transmission and reception of various types of data, such as image data, via facsimile.

A temperature sensor 126 measures temperature in the vicinity of the fixing belt 81, and transmits the temperature to the printer controller 121.

The abrasion determiner 131 determines the degree of abrasion of the fixing belt 81 with a method to be described later.

The operation panel 70 serving as hardware, includes a touch panel and a push-button key. The operation panel 70 receives an input operation from a user while performing display to the user. Input from the operation panel 70 allows setting of a condition for a printing job.

In a case where receiving, from the operation panel 70, a setting of a condition for a printing job by the user, the printer controller 121 transmits a printing-preparation command to the engine controller 111. The engine controller 111 performs a printing-preparation operation, and changes the speed of a polygon motor as necessary. The engine controller 111 changes the speed of the conveyance motor 115 as necessary.

[Relationship Between Consumption of Fixing Belt Due to Sliding between Sheet and Fixing Belt and Adhesion Amount of Toner to Sheet]

Figure 4:
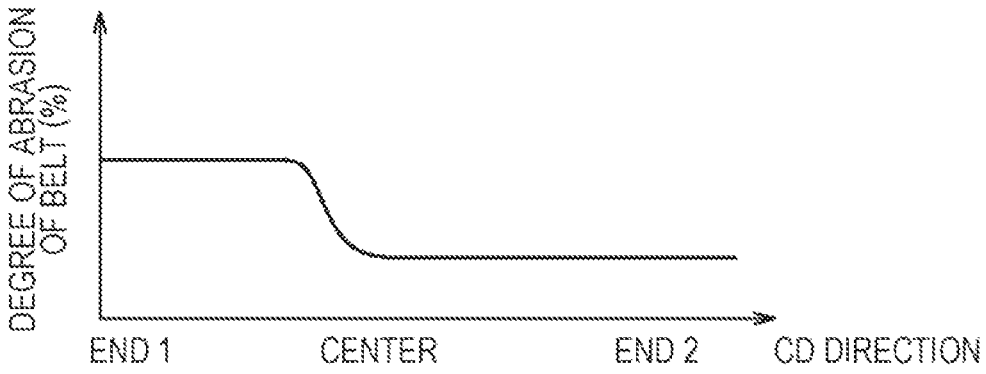
FIG. 4 is a first graph illustrating a variation in the degree of abrasion of a fixing belt in a CD direction after passage of a predetermined number of sheets through a fixing nip.
Figure 5:
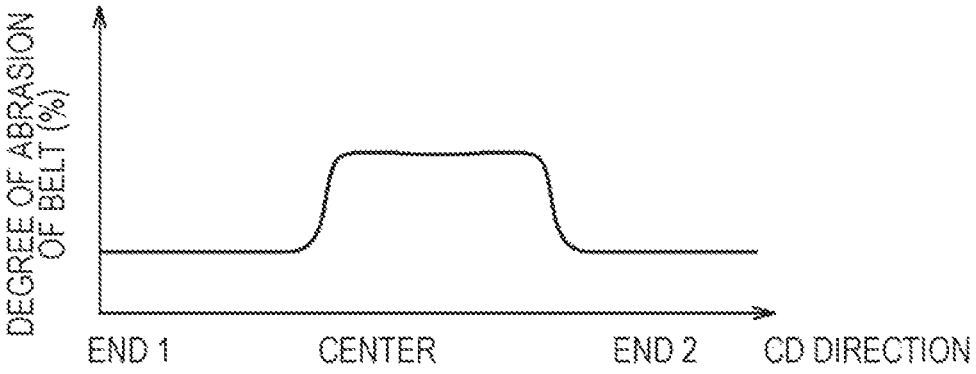
FIG. 5 is a second graph illustrating a variation in the degree of abrasion of a fixing belt in a CD direction after passage of a predetermined number of sheets through a fixing nip.

FIGS. 4 and 5 each illustrate a variation in the degree of abrasion of the fixing belt 81 in a CD direction after passage of a predetermined number of sheets though the fixing nip NP. The CD direction is orthogonal to the passing direction of a sheet (conveyance path TR).

With reference to FIGS. 4 and 5, the distribution of the adhesion amount of toner in the CD direction on a sheet that passes through the fixing nip NP, varies between FIGS. 4 and 5. The adhesion amount of toner is the amount of toner included in a toner image formed on a sheet. FIG. 4 illustrates a variation in the degree of abrasion of the fixing belt 81 in a case where the adhesion amount of toner at the end 1 (left end) in the CD direction of the toner image is small and the adhesion amount of toner at the center and the end 2 (light end) in the CD direction of the toner image is large. FIG. 4 illustrates that the degree of abrasion of the fixing belt 81 is high at the end 1 at which the adhesion amount of toner is small and the degree of abrasion of the fixing belt 81 is low at the center and the end 2 at which the adhesion amount of toner is large.

FIG. 5 illustrates a variation in the degree of abrasion of the fixing belt 81 in a case where the adhesion amount of toner at the end 1 (left end) and the end 2 (right end) in the CD direction of the toner image is large and the adhesion amount of toner at the center in the CD direction of the toner image is small. FIG. 5 illustrates that the degree of abrasion of the fixing belt 81 is high at the center at which the adhesion amount of toner is small and the degree of abrasion of the fixing belt 81 is low at the end 1 and the end 2 at Which the adhesion amount of toner is large.

The results indicate that a less adhesion amount of toner to a sheet that passes through the fixing, nip NP, causes more consumption of the corresponding portion of the fixing belt 81.

Figure 6:
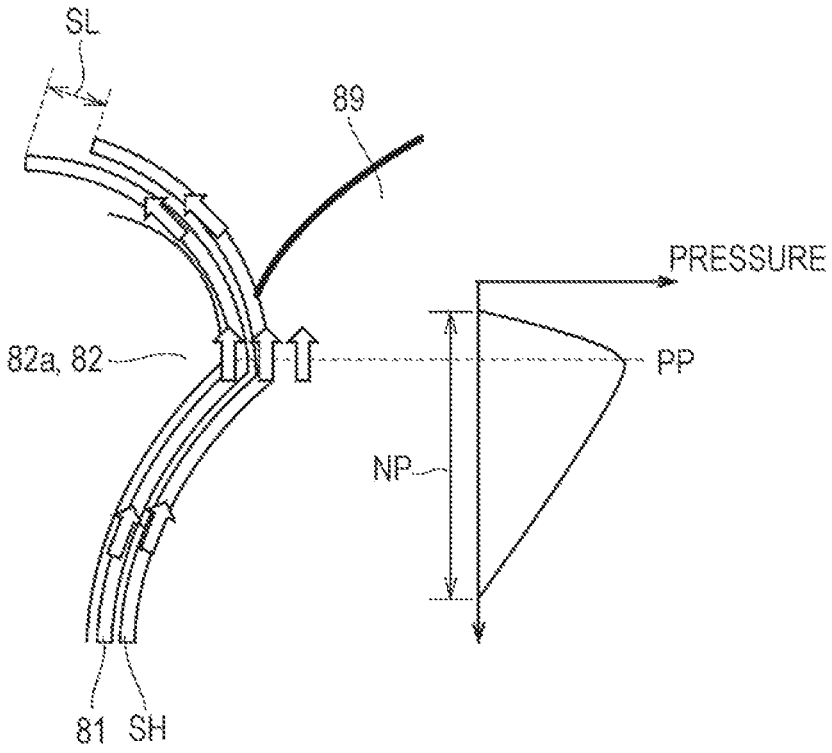
FIG. 6 is a sectional view for describing sliding between a sheet and the surface of a fixing belt.

FIG. 6 is a sectional view for describing sliding between a sheet SH and the surface of the fixing belt 81.

With reference to FIG. 6, the present inventors have found that the relationship between the consumption of the fixing belt 81 due to sliding between the sheet SH and the surface of the fixing belt 81 and the adhesion amount of toner to the sheet SH described above, results from the following reason.

Occurrence of a difference in speed between the fixing belt 81 and the sheet SH causes sliding between the fixing belt 81 and the sheet SH, resulting in occurrence of friction between the fixing belt 81 and the sheet SH. The friction consumes the fixing belt 81.

Particularly, in a case where the pressure pad 82 includes a protrusion 82*a* protruding to the pressing roller 89 side, pressing force in the fixing nip NP has a maximum value at the position PP of the front end or the protrusion 82*a*. The fixing belt 81 moves inside along the pressure pad 82, and the sheet SH moves outside along the pressure pad 82. Thus, the distance to which the sheet SH moves is long, so that the travel distance of the sheet SH is longer than the travel distance of the fixing belt 81. Sliding indicated with the amount of sliding SL, occurs between the sheet SH and the surface of the fixing belt 81. A larger amount of sliding SL causes larger friction between the sheet SH and the surface of the fixing belt 81, so that the fixing belt 81 is more likely to consume.

Meanwhile, because toner included in the toner image formed on the sheet SH has a coefficient of friction lower than the coefficient of friction of the surface of the sheet SH due to an effect such as an external additive included in the toner, the toner functions as lubricant between the fixing belt 81 and the sheet SH. Thus, a larger adhesion amount of toner to the sheet SH causes smaller friction between the fixing belt 81 and the sheet SH, so that the fixing belt 81 consumes hardly.

Therefore, the consumption of a fixing belt due to sliding between a sheet and the fixing belt, can be evaluated with the adhesion amount of toner to the sheet.

[Method of Evaluating Consumption of Fixing Belt Due to Sliding Between Sheet and Surface of Fixing Belt]

As a method of evaluating the consumption of a fixing belt due to sliding between a sheet and the fixing belt, the image forming apparatus 1 calculates the amount of toner adhering to a sheet that passes through the fixing nip NP, and determines the degree of abrasion of the fixing belt 81, on the basis of the calculated amount of toner. A method of determining the degree of abrasion of a fixing belt on the basis of the adhesion amount of toner, to be performed by the image forming apparatus 1, will be described.

Figure 7:
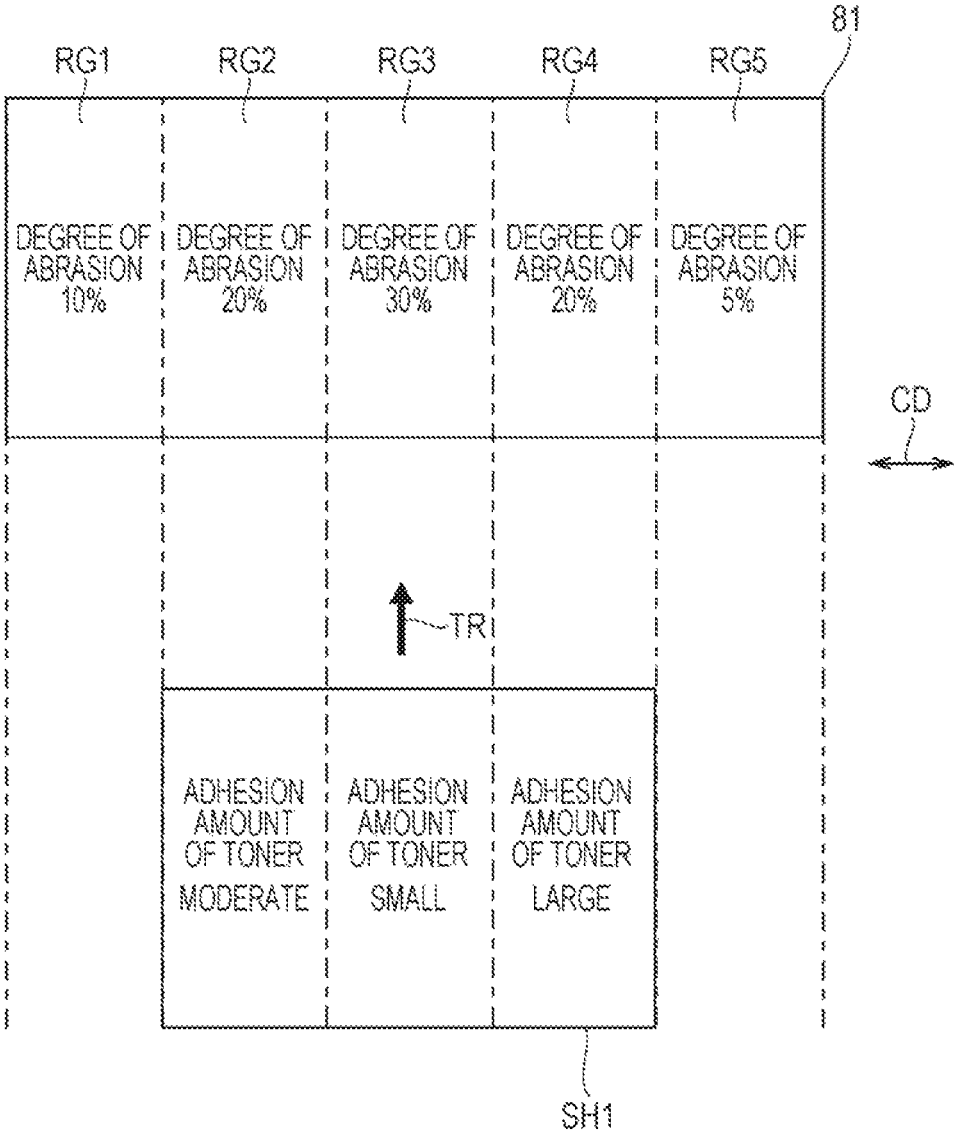
FIG. 7 schematically illustrates regions of the surface of the fixing belt according to the embodiment of the present invention, describing the degree of abrasion of the fixing belt based on the adhesion amount of toner, of each region.

FIG. 7 schematically illustrates regions RG1, RG2, RG3, RG4, and RG5 of the surface of the fixing belt 81 according to the embodiment of the present invention, describing the degree of abrasion of the fixing belt based on the adhesion amount of toner, of each region. FIG. 8 schematically illustrates a first abrasion-level table stored in the HDD 123 in the embodiment of the present invention. Note that FIG. 7 illustrates the fixing belt 81 viewed from the pressing roller 89 side.

With reference to FIGS. 7 and 8, a region forming the fixing nip NP in the fixing belt 81 is virtually divided into the plurality of regions RG1, RG2, RG3, RG4, and RG5 arranged in the CD direction (here, five regions).

The first abrasion-level table describes the degree of abrasion calculated from the adhesion amount of toner, for each of the regions RG1, RG2, RG3, RG4, and RG5. The first abrasion-level table of FIG. 8 describes values of 10%, 20%, 30%, 20%, and 5% as the degree of abrasion calculated from the adhesion amount of toner, for the regions RG1, RG2, RG3, RG4, and RG5, respectively. The values each are the cumulative value of an additional value determined with a method to be described with FIG. 9.

The abrasion determiner 131 determines the life arrival of the fixing belt 81, on the basis of the degree of abrasion of each of the regions RG1, RG2, RG3, RG4, and RG5 in the first abrasion-level table. The abrasion determiner 131 determines that the fixing belt 81 has arrived at its life, for example, in a case where the degree of abrasion of at least one region in the first abrasion-level table is 100%.

FIG. 9 schematically illustrates a first additional-value table stored in the HDD 123 in the embodiment of the present invention.

With reference to FIG. 9, the first additional-value table describes the relationship between the adhesion amount of toner of a sheet that passes through the fixing nip NP and the additional value to the degree of abrasion, calculated from the adhesion amount of toner. The first additional-value table illustrates the additional value to the degree of abrasion, calculated from the adhesion amount of toner as an additional value per sheet that passes through the fixing nip NP (%/sheet). The additional value increases as the adhesion amount of toner decreases. The adhesion amount of toner is divided into four stages of "large", "moderate", "small", and "absence" in descending order of the adhesion amount of toner ("absence" means that no sheet passes).

The first additional-value table of FIG. 9 describes values of $3\times10^{-3}$, $5\times10^{-3}$, $10\times10^{-3}$, and $1\times10^{-3}$ (%/sheet) as additional values for "large", "moderate", "small", and "absence" in the adhesion amount of toner, respectively.

The abrasion determiner 131 updates the first abrasion-level table every time a sheet passes through the fixing nip NP (every time a toner image is formed on a sheet). That is, on the basis of the image data of the toner image formed on a sheet that passes through the fixing nip NP, the abrasion determiner 131 calculates the amount of toner adhering to the respective portions of the sheet that pass through the regions RG1, RG2, RG3, RG4, and RG5, and specifies whether the adhesion amount of toner of each of the portions of the sheet that pass through the regions RG1, RG2, RG3, RG4, and RG5 is "large", "moderate", "small", or "absence". The abrasion determiner 131 determines respective additional values of the regions RG1, RG2, RG3, RG4, and RG5, on the basis of the calculated adhesion amounts of toner, with reference to the first additional-value table. Then, the abrasion determiner 131 adds the determined additional values to the respective values in the degree of abrasion of the regions RG1, RG2, RG3, RG4, and RG5 in the first abrasion-level table.

Note that the abrasion determiner 131 may update the first abrasion-level table in a case where a predetermined number of sheets have passed through the fixing nip NP (case where a toner image is formed for a predetermined number of sheets). That is the abrasion determiner 131 may store the image formed on each sheet and may calculate, in a case where the predetermined number of sheets has passed through the fixing nip NP, the average adhesion amounts of toner of the portions corresponding to the regions RG1, RG2, RG3, RG4, and RG5, in the stored images, to add additional values corresponding to the calculated adhesion amounts of toner, to the respective degrees of abrasion of the regions RG1, RG2, RG3, RG4, and RG5 in the first abrasion-level table.

With reference to FIGS. 7 and 9, here, it is assumed that one thousand sheets SH1 each having the same toner image formed pass through the regions RG2, RG3, and RG4 in the fixing nip NP. The abrasion determiner 131 specifies that the amount of toner adhering to the portion that passes through the region RG2, in the toner image on each sheet SH1, is "moderate", the amount of toner adhering to the portion that passes through the region RG3, in the toner image on each sheet SH1, is "small", and the amount of toner adhering to the portion that passes through the region RG4, in the toner image on each sheet SH1, is "large".

Figure 10:
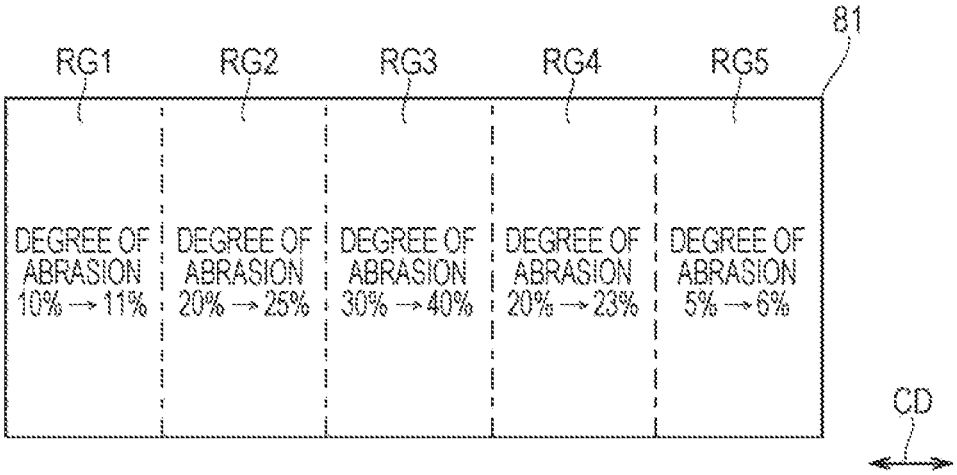
FIG. 10 schematically illustrates respective values in the degree of abrasion of the regions in the first abrasion-level table after passage of one thousand sheets through the fixing nip, in the embodiment of the present invention.

FIG. 10 schematically illustrates the respective values in the degree of abrasion of the regions RG1, RG2, RG3, RG4, and RG5 in the first abrasion-level table after passage of the one thousand sheets SH1 through the fixing nip NP, in the embodiment of the present invention.

With reference to FIG. 10, passage of the sheets SH1 through the fixing nip NP deteriorates the degrees of abrasion of the regions RG2, RG3, mid RG4 through which the sheets SH1 have passed, in the fixing belt 81. The degrees of abrasion of the regions RG1 and RG5 through which the sheets SH1 have not passed in the fixing belt 81, deteriorate slightly.

That is, because the adhesion amount of toner of each sheet SH1 that has passed through the region RG2, is "moderate", an additional value ($5\times10^{-3}$ (%/sheet)×1000 (sheets)=5(%)) indicating that the degree of deterioration in the degree of abrasion is moderate, is added to the value in the degree of abrasion of the region RG2 the first abrasion-level table. Because the adhesion amount of toner of each sheet SH1 that has passed through the region RG3, is "small", an additional value ($10\times10^{-3}$ (%/sheet)×1000 (sheets)=10(%)) indicating that the degree of detetioration in the degree of abrasion is large, is added to the value in the degree of abrasion of the region RG3 in the first abrasion-level table. Because the adhesion amount of toner of each sheet SH1 that has passed through the region RG4, is "large", an additional value ($3\times10^{-3}$ (%/sheet)×1000 (sheets)=3(%)) indicating that the degree of deterioration in the degree of abrasion is small, is added to the value in the degree of abrasion of the region RG4 in the first abrasion-level table. Because no sheet SH has passed through the regions RG1 and RG5 in the first abrasion-level table and the adhesion amount of toner of each sheet SH1 in the regions RG1 and RG5 is "absence", an additional value ($1\times10^{-3}$ (%/sheet)×1000 (sheets)=1(%)) indicating that the degree of deterioration in the degree of abrasion is minute, is added to the respective values in the degree of abrasion of the regions RG1 and RG5. The respective values in the degree of abrasion of the regions RG1, RG2, RG3, RG4, and RG5 in the first abrasion-level table after the passage of the one thousand sheets SH1 through the fixing nip NP, are updated to 11%, 25%, 40%, 23%, and 6%.

Figure 11:
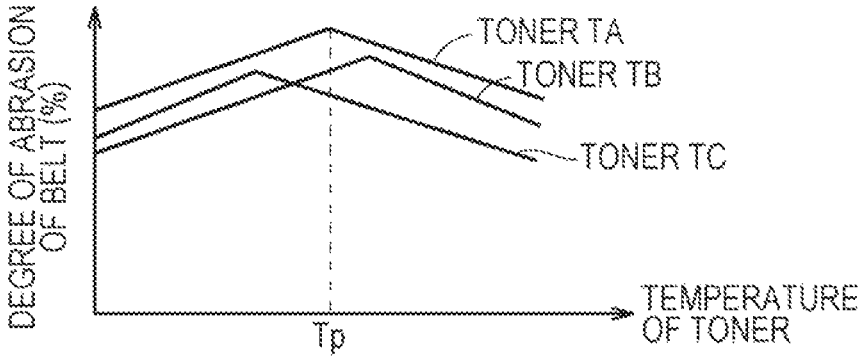
FIG. 11 schematically illustrates the relationship between the temperature of toner adhering to a sheet and the degree of abrasion of the fixing belt after passage of a predetermined number of sheets through the fixing nip.

FIG. 11 schematically illustrates the relationship between the temperature of toner adhering to a sheet and the degree of abrasion of the fixing belt 81 after passage of a predetermined number of sheets through the fixing nip NP.

With reference to FIG. 11, because the viscosity of toner varies depending on the material and the temperature of toner, the material and the temperature of toner influence the degree of abrasion of the fixing belt 81.

The relationship between the temperature and the viscosity of toner, mutually varies depending on the material of toner. Thus, when the material of toner varies, the curve indicating the relationship between the temperature of toner and the degree of abrasion of the fixing belt 81, varies. FIG. 11 illustrates curves indicating the relationship between the temperature of toner and the degree of abrasion of the fixing belt 81, for toners TA, TB, and TC including mutually different materials.

Focusing on the curve of the toner TA, the increase in the degree of abrasion of the fixing belt 81 due to passage of a sheet, is maximum in a case where the temperature of toner is temperature Tp. The increase in the degree of abrasion of the fixing belt 81 due to passage of a sheet, decreases as the temperature of toner deviates from the temperature Tp.

Thus, the abrasion determiner 131 may correct the specified additional values from the first additional-value table, on the basis of at least one of the material and the temperature of toner adhering to a sheet that passes through the fixing NP, and may add the corrected additional values to the degree of abrasion in the first abrasion-level table.

In this case, the abrasion determiner 131 may acquire information regarding the material of toner (e.g., the color and the viscosity of toner), for example, from reading of information (e.g., product number) stored in an integrated circuit (IC) chip provided at a toner bottle, with the toner controller or from information regarding the toner bottle, input by the user through the operation panel 70. The abrasion determiner 131 may acquire, as the temperature of toner, temperature in the vicinity of the fixing belt 81 measured by the temperature sensor 126.

FIG. 12 schematically illustrates an additional-value correction table stored in the HDD 123, in the embodiment of the present invention.

With reference to FIG. 12, the abrasion determiner 131 may refer to the additional-value correction table, in a case where correcting the specified additional values from the first additional-value table, on the basis of the material and the temperature of toner adhering to a sheet that passes through the fixing nip NP. The additional-value correction table describes the relationship between the material and the temperature of toner and the coefficient by which each of the specified additional values from the first additional-value table is to be multiplied (correction value of correcting each additional value).

As an example, the additional-value correction table of FIG. 12 describes that the specified additional values from the first additional-value table are to be multiplied by a coefficient of "1.1" when the temperature of toner is higher than a predetermined standard-value range in a case where the material of toner adhering to a sheet is the toner TA. The additional-value correction table describes that the specified additional values from the first additional-value table are to be multiplied by a coefficient of "1.2" when the temperature of toner remains in the predetermined standard-value range in a case where the material of toner adhering to a sheet is the toner TA. The additional-value correction table describes that the specified additional values from the first additional-value table are to be multiplied by a coefficient of "1.1" when the temperature of toner is lower than the predetermined standard-value range in a case where the material of toner adhering to a sheet is the toner TA.

For example, the abrasion determiner 131 may acquire the correction value from the PC 203 or 204 connected to the image forming apparatus 1 or the operation panel 70 and may replace the coefficient described in the additional-value correction table with the acquired correction value. In this case, the specified additional values from the first additional-value table are corrected with the acquired correction value.

FIGS. 13A to 13C schematically illustrate variations in the positional relationship between the protrusion 82*a* of the pressure pad 82 and the pressing roller 89. Note that the overlap between the pressure pad 82 and the pressing roller 89 in FIGS. 13A to 13C corresponds to the fixing nip NP.

In FIG. 13A, the protrusion 82*a* is present from the fixing nip NP across the downstream side in the conveyance direction of the fixing nip NP. In FIG. 13B, the entire protrusion 82*a* is present in the fixing nip NP. In FIG. 3C, no protrusion 82*a* is present in the fixing nip NP, but the protrusion 82*a* is present on the downstream side in the conveyance direction with respect to the fixing nip NP.

In FIGS. 13A and 13B, the pressing force between the fixing belt 81 and the pressing roller 89 is maximum on the downstream side with respect to a central position CL in the conveyance direction in the fixing nip NP (passing direction of a sheet) (hereinafter, this type of configuration is also referred to as a fixing-nip downstream-side pressing configuration). In FIGS. 13A and 13B, a sheet that has passed through the fixing nip NP is conveyed in a direction close to the surface of the pressure pad 82.

Meanwhile, in FIG. 13C, the pressing force between the fixing belt 81 and the pressing roller 89 is maximum at substantially the central position CL in the conveyance direction in the fixing nip NP (passing direction of a sheet) (hereinafter, this type of configuration is also referred to as a fixing-nip center pressing configuration). In FIG. 13C, a sheet that has passed through the fixing nip NP is conveyed in a direction away from the surface of the pressure pad 82.

In the fixing-nip downstream-side pressing configuration as in FIGS. 13A and 13B, the distance to which the fixing belt 81 and a sheet move along the pressure pad 82, is long and the amount of sliding SL (FIG. 6) is large, so that the fixing belt 81 is more likely to abrade progressively. Thus, the method of determining the degree of abrasion of a fixing belt on the basis of the adhesion amount of toner described above, is effective particularly.

[Method of Evaluating Consumption of Fixing Belt Due to Passage of Edge of Sheet]

In addition to evaluating the consumption of a fixing belt in terms of sliding between a sheet and the fixing belt (adhesion amount of toner to a sheet) as described above, the image forming apparatus 1 may evaluate the consumption of the fixing belt in terms of passage of the edges of the sheet (both ends in the CD direction).

As a method of evaluating the consumption of a fixing belt due to passage of the edges of a sheet, the image forming apparatus 1 may determine the degree of abrasion of the fixing belt 81, on the basis of the passing positions of the edges of a sheet that passes through the fixing nip NP. A method of determining the degree of abrasion of a fixing belt on the basis of the passing positions of the edges of a sheet, to be performed by the image forming apparatus 1, will be described below.

Figure 14:
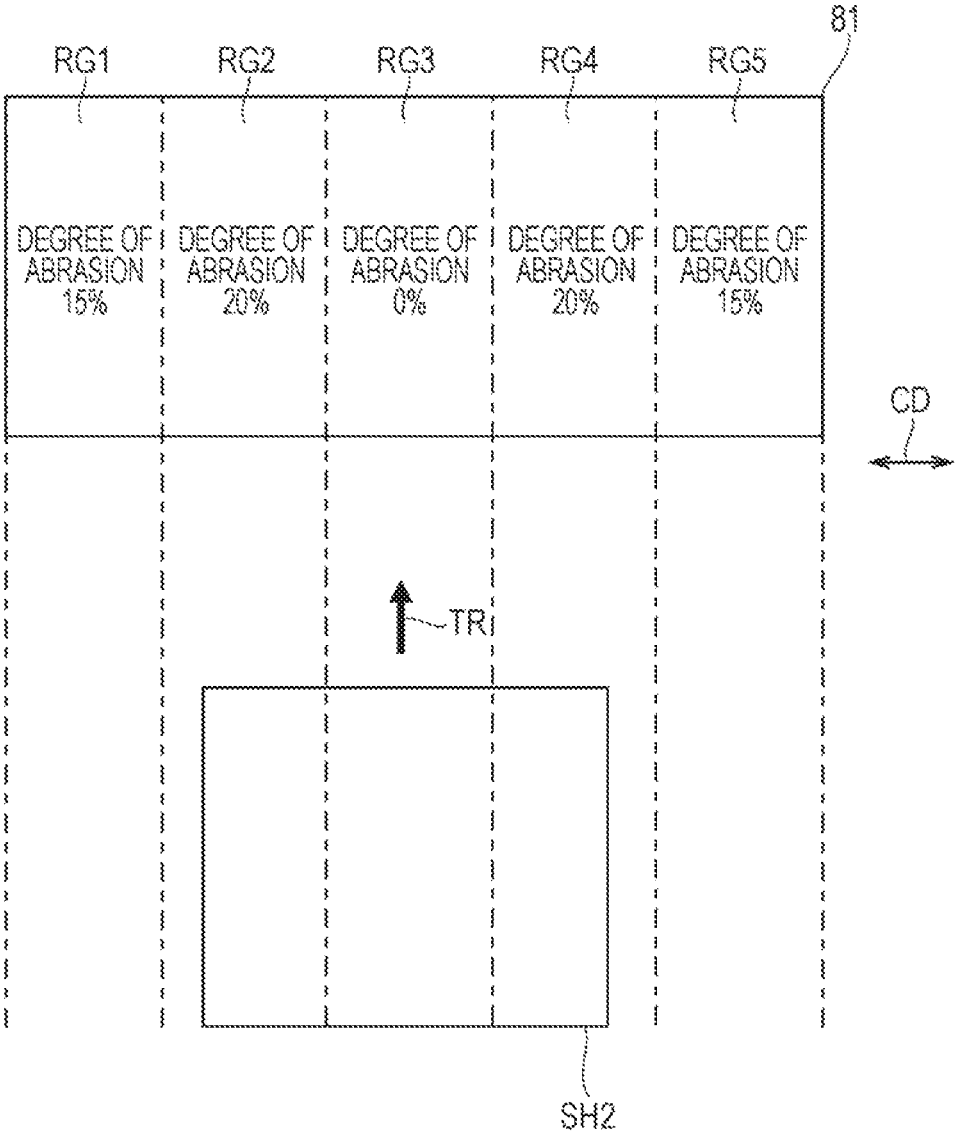
FIG. 14 schematically illustrates regions of the surface of the fixing belt according to the embodiment of the present invention, describing the degree of abrasion of the fixing belt based on the passing positions of edges, of each region.

FIG. 14 schematically illustrates regions RG1, RG2, RG3, RG4, and RG5 of the surface of the fixing belt 81 according to the embodiment of the present invention, describing the degree of abrasion of the fixing belt based on the passing positions of edges, of each region. FIG. 15 schematically illustrates a second abrasion-level table stored in the HDD 123 in the embodiment of the present invention. Note that FIG. 14 illustrates the fixing belt 81 viewed from the pressing roller 89 side.

With reference to FIGS. 14 and 15, similarly to the method of determining the degree of abrasion of a fixing belt on the basis of the adhesion amount of toner, a region forming the fixing nip NP in the fixing belt 81 is virtually divided into the plurality of regions RG1, RG2, RG3, RG4, and RG5 arranged in the CD direction (here, five regions).

Note that the region to be used in the method of determining the degree of abrasion of a fixing belt on the basis of the passing positions of the edges may be identical to or different from the region to be used in the method of determining the degree of abrasion of a fixing belt on the basis of the adhesion amount of toner.

It is known that, during passage of a sheet SH2 through the fixing nip NP, occurrence of shearing force at the passing positions of the edges of the sheet SH2 in the fixing belt 81, due to the difference between the coefficient of friction of the sheet SH2 and the coefficient of friction of the pressing roller 89, causes the fixing belt 81 to abrade progressively. As the sheet SH2 increases in thickness, the shearing force that occurs in the fixing belt 81 increases.

The second abrasion-level table describes the degree of abrasion calculated from the passing positions of the edges, for each of the regions RG1, RG2, RG3, RG4, and RG5. The second abrasion-level table of FIG. 14 describes values of 15%, 20%, 0%, 20%, and 15% as the degree of abrasion calculated from the passing positions of the edges of a sheet, for the regions RG1, RG2, RG3, RG4, and RG5, respectively. The values each are the cumulative value of an additional value determined with a method to be described with FIG. 16.

The abrasion determiner 131 further determines the life arrival of the fixing belt 81, on the basis of the degree of abrasion of each of the regions RG1, RG2, RG3, RG4, and RG5 in the second abrasion-level table. In a case where determining the degree of abrasion of the fixing belt 81 on the basis of the passing positions of the edges in addition to the determination of the degree of abrasion of the fixing belt based on the adhesion amount of toner, the abrasion determiner 131 determines that the fixing belt 81 has arrived at its life, for example, in a case where the degree of abrasion of at least one region in the first abrasion-level table and the second abrasion-level table is 100% (exemplary first threshold value).

FIG. 16 schematically illustrates a second additional-value table stored in the HDD 123 in the embodiment of the present invention.

With reference to FIG. 16, the second additional-value table describes the relationship between the type (material) of a sheet and the additional value to the degree of abrasion, calculated from the passing positions of the edges. The second additional-value table illustrates the additional value to the degree of abrasion, calculated from the passing positions of the edges as an additional value per sheet that passes through the fixing nip NP (%/sheet).

The second additional-value table of FIG. 16 describes values of "1", "2", and "3" as additional values for "thin paper", "plain paper", and "thick paper" in the type of a sheet, respectively. As a sheet increases in thickness, the shearing force that occurs in the fixing belt 81 increases and then the fixing belt 81 abrades progressively. Thus, the additional value increases.

The abrasion determiner 131 updates the second abrasion-level table every time a sheet passes through the fixing nip NP (every time a toner image is formed on a sheet). That is the abrasion determiner 131 specifies regions to be the passing positions of the edges of a sheet that passes through the fixing nip NP, the basis of the size of a sheet that passes through the fixing nip NP (size of a sheet to be used in a printing job set through the operation panel 70). The abrasion determiner 131 determines an additional value, on the basis of the material of a sheet that passes through the fixing nip NP (material of a sheet to be used in a printing job set through the operation panel 70), with reference to the second additional-value table. The abrasion determiner 131 adds the determined additional value to the values in the degree of abrasion of the regions to be the passing positions of the edges of a sheet, in the second abrasion-level table.

Note that the abrasion determiner 131 may correct the specified additional value from the second additional-value table, on the basis of a factor, such as the temperature of a sheet, and may add the corrected additional value to the degree of abrasion in the second abrasion-level table. The abrasion determiner 131 may determine a certain additional value regardless of the material of a sheet.

With reference to FIGS. 14 and 16, here, it is assumed that one thousand sheets SH2 all the same size pass through the regions RG2, RG3, and RG4 in the fixing nip NP. The abrasion determiner 131 specifies that the material of each sheet SH2 is "thick paper", and specifies that the passing position of one edge in the CD direction of each sheet SH2 is in the region RG2 and the passing position of the other edge in the CD direction of each sheet SH2 is in the region RG4.

Figure 17:
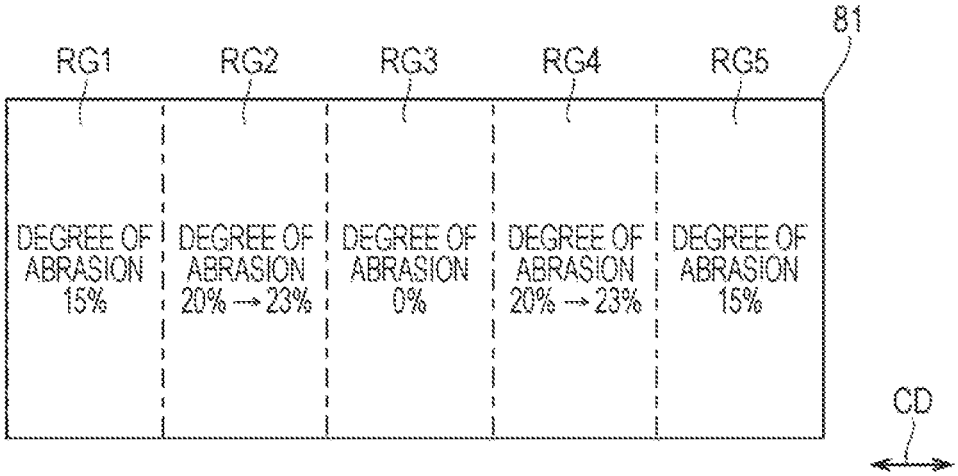
FIG. 17 schematically illustrates respective values in the degree of abrasion of the regions in the second abrasion-level table after passage of one thousand sheets through the fixing nip, in the embodiment of the present invention.

FIG. 17 schematically illustrates the respective values in the degree of abrasion of the regions RG1, RG2, RG3, RG4, and RG5 in the second abrasion-level table after passage of the one thousand sheets SH2 through the fixing nip NP, in the embodiment of the present invention.

With reference to FIG. 17, passage of the sheets SH2 through the fixing nip NP deteriorates the degrees of abrasion of the regions RG2 and RG4 through which the edges of the sheets SH2 have passed, in the fixing belt 81. The regions RG1, RG3, and RG5 through which the edges of the sheets SH2 have not passed, in the fixing belt 81 do not deteriorate.

That is, because the material of each sheet SH2 is "thick paper", an additional value corresponding to the thick paper ($3\times10^{-3}$ (% sheet)×1000 (sheet)=3(%)), to the values in the degree of abrasion of the regions RG2 and RG4 in the second abrasion-level table. The values in the degree of abrasion of the regions RG1, RG3, and RG5 through which the edges of the sheets SH2 have not passed, do not vary. The values in the degree of abrasion of the regions RG2 and RG4 in the second abrasion-level table after the passage of the one thousand sheets SH2 through the fixing nip NP, both are updated to 23%.

[Method of Predicting Remaining Life of Fixing Belt]

The abrasion determiner 131 may predict the remaining life of the fixing belt 81, for example, with the following method, on the basis of the degrees of abrasion described in the first and second abrasion-level tables.

Figure 18:
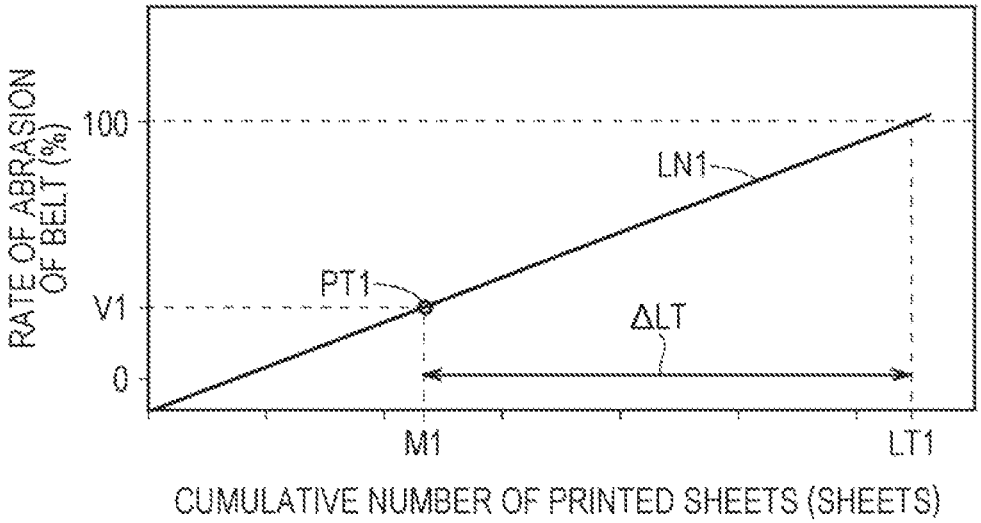
FIG. 18 is a graph for describing a method of predicting the remaining life of the fixing belt according to the embodiment of the present invention.

FIG. 18 is a graph for describing a method of predicting the remaining life of the fixing belt 81 according to the embodiment of the present invention.

With reference to FIG. 18, the abrasion determiner 131 extracts the highest value V1 from the degrees of abrasion described in the first and second abrasion-level tables. As an example, in a case where the first abrasion-level table includes the contents of FIG. 8 and the second abrasion-level table includes the contents of FIG. 15, a value of "30%" that is the degree of abrasion of the region RG3 in the first abrasion-level table, is extracted as the value V1.

Next, the abrasion determiner 131 predicts the cumulative number of printed sheets LT1 with which the degree of abrasion is predicted to be 100% (exemplary second threshold value), on the basis of the extracted value V1 in the degree of abrasion and the cumulative number of printed sheets M1 of the image forming apparatus 1.

Specifically, the abrasion determiner 131 plots a point PT1 prescribed by the extracted value V1 in the degree of abrasion and the cumulative number of printed sheets M1, on biaxial coordinates in which the x axis represents the cumulative number of printed sheets (sheets) and the y axis represents the rate of abrasion of the fixing belt (%), and then determines, as the cumulative number of printed sheets LT1, the x-value in a case where the y-value of a straight line LN1 connecting the point PT1 and the origin of the biaxial coordinates is 100%.

The abrasion determiner 131 calculates the difference ΔLT between the predicted cumulative number of printed sheets LT1 and the current cumulative number of printed sheets M1, predicts the difference ΔLT as the remaining life of the fixing belt 81, and stores the difference ΔLT into the HDD 123.

[Display onto Operation Panel]

The printer controller 121 may display information regarding the life of the fixing belt 81, onto the operation panel 70 with necessary timing.

FIG. 19 schematically illustrates a screen to be displayed on the operation panel 70 in the embodiment of the present invention.

With reference to FIG. 19, the operation panel 70 displays that the degrees of abrasion of the left end, the center, and the right end of the fixing belt 81 determined on the basis of the adhesion amount of toner, are 90%, 30%, and 50%, respectively. The operation panel 70 displays that the degree of abrasion of the fixing belt determined on the basis of the passing positions of the edges is 80%. Furthermore, the operation panel 70 displays that the printable number of sheets until the life arrival of the fixing belt, is approximately 1000.

As the degree of abrasion of the left end of the fixing belt 81, the higher value from the values in the degree of abrasion of the regions RG1 and RG2 described in the first abrasion-level table, is displayed. As the degree of abrasion of the center of the fixing belt 81, the value of the region RG3 described in the first abrasion-level table, is displayed. As the degree of abrasion of the right end of the fixing belt 81, the higher value from the values in the degree of abrasion of the regions RG4 and RG5 described in the first abrasion-level table, is displayed. As the degree of abrasion of the fixing belt determined on the basis of the passing positions of the edges, the highest value from the values in the degree of abrasion of the regions RG1, RG2, RG3, RG4, and RG5 described in the second abrasion-level table, is displayed. As the printable number of sheets until the life arrival of the fixing belt, the remaining life of the fixing belt 81 stored in the HDD 123 (difference ΔLT of FIG. 18) is displayed.

The abrasion determiner 131 further displays a message warning that the fixing belt is close to the time for replacement, in a case where the remaining life of the fixing belt 81 stored in the HDD 123 falls below a predetermined value.

[Operation on Life Arrival]

In a case where the abrasion determiner 131 determines that the fixing belt 81 has arrived at its life, the engine controller 111 or the printer controller 121 performs the following operation on the life arrival.

As the operation on the life arrival, the engine controller 111 (i) may stop the printing of a printing job input in the image forming apparatus 1 after the life arrival, (ii) may transfer, in a case where a printing job is input after the life arrival (particularly, a printing job in which the adhesion amount of toner to a sheet is less than a predetermined amount), the printing job to another image forming apparatus, or (iii) may set, for printing after the life arrival, the fixing temperature of the fixer 58 at a higher temperature than the fixing temperature before the life arrival.

For (iii) described above, as the degree of abrasion of the fixing belt 81 increases, the fixing performance of the fixer 58 deteriorates, so that an offset is more likely to occur. Setting the fixing temperature of the fixer 58 at a higher temperature, enables compensation of the deterioration in the fixing performance of the fixer 58, so that the offset can be inhibited from occurring.

As the operation on the life arrival, for stopping of the printing of a printing job input in the image forming apparatus 1 after the life arrival (for (i) described above), the printer controller 121 may transfer the input printing job to another image forming apparatus (e.g., MFP 201 or 202 of FIG. 1).

The printer controller 121 may receive a setting of stopping or not stopping the printing in a case where the fixing belt 81 has arrived at its life, through the operation panel 70. When the printing is perforated after the life arrival for reception of a setting of not stopping the printing in a case where the fixing belt 81 has arrived at its life, the engine controller 111 may set the fixing temperature of the fixer 58 at a higher temperature than the fixing temperature before the life arrival.

[Flowchart]

Figure 20:
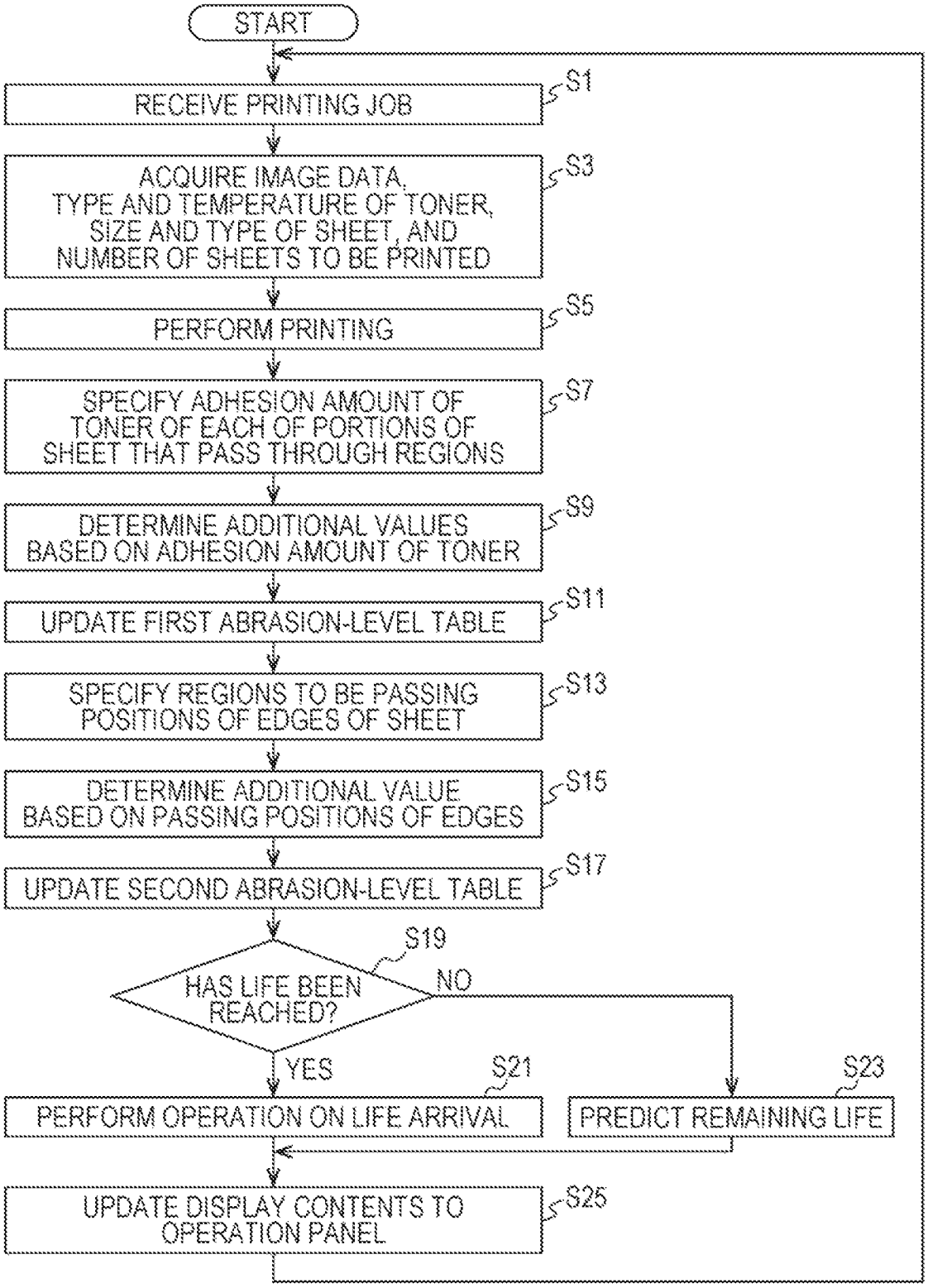
FIG. 20 is a flowchart of the operation of the image forming apparatus according to the embodiment of the present invention.

FIG. 20 is a flowchart of the operation of the image forming apparatus 1 according to the embodiment of the present invention. The flowchart is achieved by execution of the control program stored in the HDD 123, by a central processing unit (CPU) of the controller 30.

With reference to FIG. 20, when receiving a printing job (S1), the controller 30 acquires image data regarding the printing job, the type (material) and the temperature of toner, the size and the type (material) of a sheet set in the printing job, and information regarding the number of sheets to be printed (S3). Next, the controller 30 performs printing (S5), and specifies the adhesion amount of toner of each of the portions of a sheet that pass through the regions RG1, RG2, RG3, RG4, and RG5 in the fixing belt 81, on the basis of the image data (S7).

Next, the controller 30 determines respective additional values of the regions RG1, RG2, RG3, RG4, and RG5, on the basis of the specified adhesion amount of toner, the material and the temperature of toner, and the number of sheets (S9), and adds the determined additional values to the regions, to update the first abrasion-level table (S11). Subsequently, the controller 30 specifies regions to be the passing positions of the edges of a sheet, on the basis of the size of a sheet (S13), and determines an additional value, on the basis of the material of a sheet and the number of sheets to be printed (S15). Next, the controller 30 adds the determined additional value to the specified regions, to update the second abrasion-level table (S17).

Subsequently, the controller 30 determines whether the fixing belt 81 has arrived at its life (S19). At step S19, the controller 30 determines that the fixing belt 81 has arrived at its life, in a case where the degree of abrasion of at least one region in the first abrasion-level table and the second abrasion-level table is 100%.

At step S19, in a case where determining that the fixing belt 81 has arrived at its life (YES at S19), the controller 30 performs the operation on the life arrival (S21), and proceeds to the processing at step S25.

At step S19, in a case where determining that the fixing belt 81 has not arrived at its life (NO at S19), the controller 30 predicts the remaining life of the fixing belt 81 (S23), and proceeds to the processing at step S25.

At step S25, the controller 30 updates display contents to the operation panel 70, on the basis of the updated contents in the first and second abrasion-level tables (S25), and proceeds to the processing at step S1.

[Modification]

(1) First Modification

Figure 21:
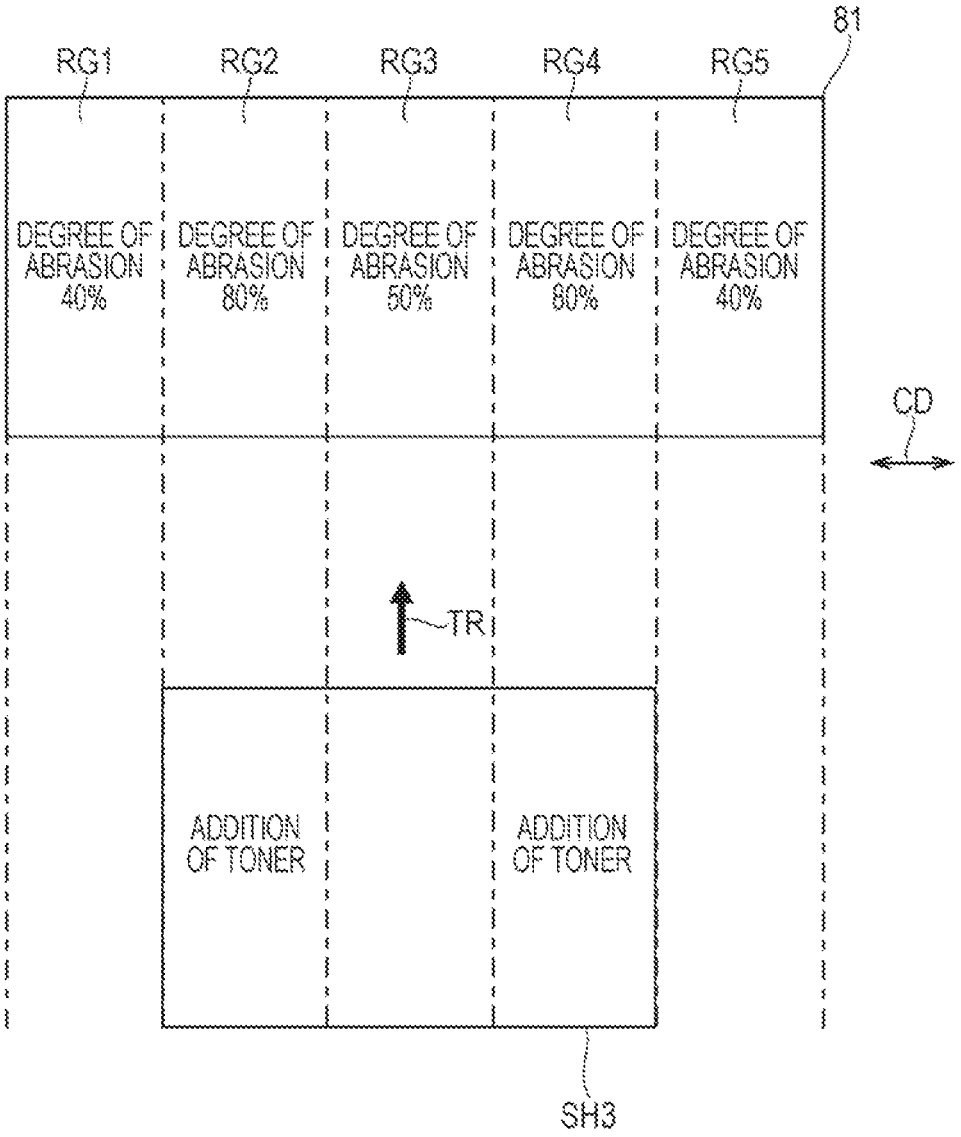
FIG. 21 is a diagram for describing the operation of the image forming apparatus according to a first modification of the embodiment of the present invention.

FIG. 21 is a diagram for describing the operation of the image forming apparatus 1 according to a first modification of the embodiment of the present invention.

With reference to FIG. 21, the image forming apparatus 1 according to the first modification adds, in a case where the degree of abrasion of a region is higher than the degree of abrasion of another region by a predetermined value or more in the respective degrees of abrasion of the plurality of regions described in the first abrasion-level table, toner to the portion that passes through the region, in a sheet on which a toner image of a new printing job is to be formed.

Here, it is assumed that the degrees of abrasion of the regions RG1, RG2, RG3, RG4, and RG5 described in the first abrasion-level table are 40%, 80%, 50%, 80, and 40%, respectively. In this case, the degrees of abrasion of the regions RG2 and RG4 are higher than the degrees of abrasion of the other regions by the predetermined value or more (e.g., 30%).

In this case, when the toner image based on image data of the new printing job is formed on a sheet SH3, the engine controller 111 adds toner to the portions of the toner image that pass through the regions RG2 and RG4 in which the degree of abrasion is high, on the sheet SH3. The toner to be added may be minute in quantity, and is preferably toner of a color, such as yellow, the color being less likely to influence image quality.

When the sheet SH3 with the addition of toner passes through the fixing nip NP, the regions RG2 and RG4 in the fixing belt 81 improve in lubricity due to the added toner, resulting in inhibition of an event in which the fixing belt 81 abrades locally progressively.

(2) Second Modification

Figure 22:
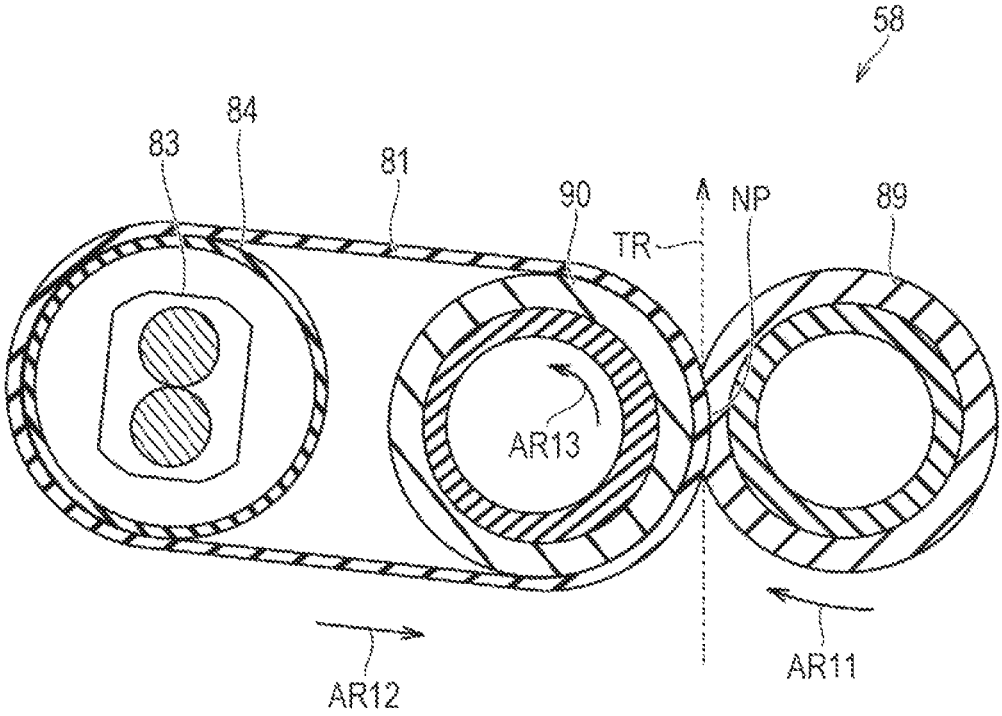
FIG. 22 is a schematic sectional view of the configuration of the fixer according to a second modification of the embodiment of the present invention.

FIG. 22 is a schematic sectional view of the configuration of the fixer 58 according to a second modification of the embodiment of the present invention.

With reference to FIG. 22, according to the second modification, the fixing belt 81 is stretched by a roller 90 and the heating roller 84. The roller 90 is disposed inside the fixing belt 81. The roller 90 extends parallel to the extending direction of the central axis R of the pressing roller 89. The roller 90 pushes the fixing belt 81 from the inside of the fixing belt 81, resulting in formation of the fixing nip NP between the fixing belt 81 and the pressing roller 89. The roller 90 rotates in the direction indicated with an arrow AR13 in accordance with rotation of the fixing belt 81.

The fixer 58 according to the second modification has a fixing-nip center pressing configuration. That is, the fixer 58 according to the second modification, the pressing force between the fixing belt 81 and the pressing roller 89 is maximum at substantially a central position in the conveyance direction in the fixing nip NP (passing direction of a sheet).

Figure 23:
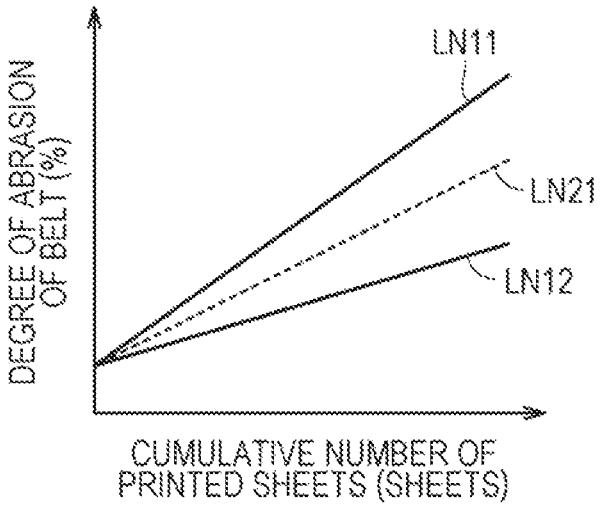
FIG. 23 schematically illustrates the relationship between the degree of abrasion of a fixing belt due to the friction between a sheet and the fixing belt, the degree of abrasion of a fixing belt due to passage of the edges of a sheet, and the cumulative number of printed sheets, in the fixer having a fixing-nip downstream-side pressing configuration.
Figure 24:
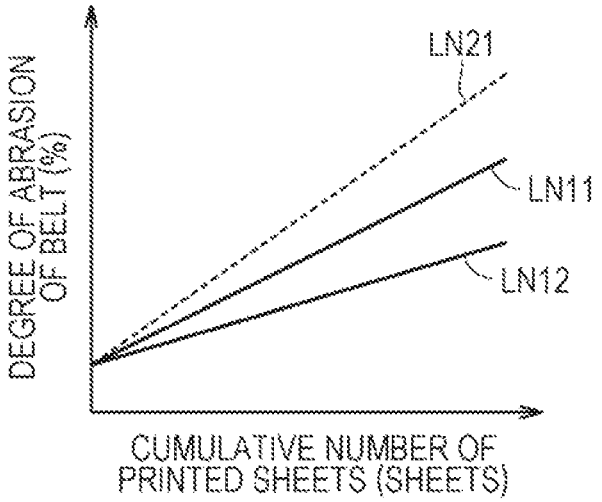
FIG. 24 schematically illustrates the relationship between the degree of abrasion of a fixing belt due to the friction between a sheet and the fixing belt, the degree of abrasion of a fixing belt due to passage of the edges of a sheet, and the cumulative number of printed sheets, in the fixer having a fixing-nip center pressing configuration.

FIG. 23 schematically illustrates the relationship between the degree of abrasion of a fixing belt due to the friction between a sheet and the fixing belt, the degree of abrasion of a fixing belt due to passage of the edges of a sheet, and the cumulative number of printed sheets, in the fixer 58 having a fixing-nip downstream-side pressing configuration. FIG. 24 schematically illustrates the relationship between the degree of abrasion of a fixing belt due to the friction between a sheet and the fixing belt, the degree of abrasion of a fixing belt due to passage of the edges of a sheet, and the cumulative number of printed sheets, in the fixer 58 having the fixing-nip center pressing configuration. FIGS. 23 and 24 each illustrate a line LN11 indicating the relationship between the degree of abrasion of a fixing belt due to the friction between the fixing belt and a sheet, with a small adhesion amount of toner to a sheet, and the cumulative number of printed sheets. A line LN12 indicates the relationship between the degree of abrasion of a fixing belt due to the friction between a sheet and the fixing belt, with a large adhesion amount of toner to a sheet, and the cumulative number of printed sheets. A line LN21 indicates the relationship between the degree of abrasion of a fixing belt due to passage of the edges of a sheet and the cumulative number of printed sheets.

With reference to FIG. 23, with the fixing-nip downstream-side pressing configuration (configurations of FIGS. 13A and 13B), the consumption of a fixing belt due to sliding between the surface of the fixing belt and a sheet with a small adhesion amount of toner (line LN11 in FIG. 23) tends to be more dominant than the consumption of a fixing belt due to passage of the edges of a sheet (line LN21 in FIG. 23).

Therefore, evaluation of the life of a fixing belt with the degree of abrasion determined with the method of determining the degree of abrasion of a fixing belt on the basis of the adhesion amount of toner described above, is effective for the fixing-nip downstream-side pressing configuration.

With reference to FIG. 24, meanwhile, with the fixing-nip center pressing configuration (configurations of FIGS. 13C and 22), the consumption of a fixing belt due to passage of the edges of a sheet (line LN21 in FIG. 24) tends to be more dominant than the consumption of a fixing belt due to the friction between the fixing belt and a sheet with a small adhesion amount of toner (line LN11 in FIG. 23).

Therefore, evaluation of the life of a fixing belt with both of the degree of abrasion determined with the method of determining the degree of abrasion of a fixing belt on the basis of the adhesion amount of toner and the degree of abrasion determined with the method of determining the degree of abrasion of a fixing belt on the basis of the passing positions of the edges, described above, is effective for the fixing-nip center pressing configuration.

(3) Third Modification

With reference to FIG. 3, the controller 30 may transmit a parameter for determining the degree of abrasion of the fixing belt 81, for example, to the PC 203 having a server function, connected to the image forming apparatus 1. The parameter to be transmitted is required to include at least one of the respective degrees of abrasion of the plurality of regions RG1, RG2, RG3, RG4, and RG5 (degree of abrasion described in the first abrasion-level table), the size of a sheet, the type of a sheet, the temperature of a sheet, and the respective amounts of toner adhering to the portions of a sheet that pass through the plurality of regions. This arrangement enables unified management of the respective degrees of abrasion of fixing belts in the plurality of image forming apparatuses connected to the LAN.

Effect According to Embodiment

According to the embodiment described above, the consumption of a fixing belt due to sliding between a sheet and the surface of the fixing belt, is evaluated on the basis of the adhesion amount of toner to a sheet that passes through a fixing nip, resulting in accurate evaluation of the consumption of a fixing belt.

[Others]

According to the embodiment described above, the region forming the fixing nip NP in the fixing belt 81 is virtually divided into the plurality of regions RG1, RG2, RG3, RG4, and RG5. However, the number of divided regions is arbitrary, and thus the region forming the fixing nip NP in the fixing belt 81 may include only one region (no division may be made).

The processing according to the embodiment and the modifications described above, may be performed by software or use of a hardware circuit. A program for executing the processing according to the embodiment and the modifications described above, can be provided. The program recorded in a recording medium, such as a CD-ROM, a flexible disk, a hard disk, a ROM, a RAM, or a memory card, may be provided to a user. The program is executed by a computer, such as a CPU. The program may be downloaded to a device through a communication line, such as the Internet.

Although embodiments and modifications of the present invention have been described and illustrated in detail, the disclosed embodiments are made for purposes of illustration and example only and not limitation. The scope of the present invention should be interpreted by terms of the appended claims instead of the above descriptions. It is intended that the scope of the present invention includes the meaning of equivalents of the scope of the claims and all alternations in the scope thereof.

What is claimed is:

1. An image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the image forming apparatus comprising a hardware processor that calculates an amount of the toner adhering to the sheet that passes through the fixing nip, and determines a degree of planar abrasion of the fixing belt, based on the amount of the toner calculated by the hardware processor, wherein the hardware processor stores the degree of planar abrasion of the fixing belt, and adds an additional value based on the amount of the toner calculated by the hardware processor, to the degree of planar abrasion stored in the hardware processor, and wherein the hardware processor divides a region forming the fixing nip in the fixing belt, into a plurality of regions arranged in a direction orthogonal to a passing direction of the sheet, to calculate the respective amounts of the toner adhering to portions of the sheet that pass through the plurality of regions, stores the respective degrees of planar abrasion of the plurality of regions, and adds the respective additional values of the plurality of regions calculated by the hardware processor, to the respective degrees of planar abrasion of the plurality of regions.

2. The image forming apparatus according to claim 1, wherein the hardware processor determines life arrival of the fixing belt, based on the respective degrees of planar abrasion of the plurality of regions stored in the hardware processor.

3. The image forming apparatus according to claim 2, wherein the hardware processor further determines the life arrival of the fixing belt, based on a degree of edge abrasion that is the degree of abrasion determined based on a passing position of an edge of the sheet that passes through the fixing nip.

4. The image forming apparatus according to claim 3, wherein the hardware processor determines that the fixing belt has arrived at the life, in a case where at least one of the respective degrees of planar abrasion of the plurality of regions stored in the hardware processor and the degree of edge abrasion, is a first threshold value.

5. The image forming apparatus according to claim 2, wherein the hardware processor transfers a printing job input in the image forming apparatus, to another image forming apparatus in a case where the hardware processor determines that the fixing belt has arrived at the life.

6. The image forming apparatus according to claim 2, further comprising: a setting receiver that receives a setting of causing the image forming apparatus to stop printing or not to stop the printing in a case where the fixing belt has arrived at the life.

7. The image forming apparatus according to claim 6, wherein the hardware processor sets, when the hardware processor determines that the fixing belt has arrived at the life, after the setting receiver receives the setting of causing the image forming apparatus not to stop the printing, a fixing temperature of the fixer higher than a fixing temperature of the fixer before the hardware processor determines that the fixing belt has arrived at the life.

8. The image forming apparatus according to claim 1, wherein the hardware processor predicts a remaining life of the fixing belt, based on the respective degrees of planar abrasion of the plurality of regions stored in the hardware processor.

9. The image forming apparatus according to claim 8, wherein the hardware processor predicts the remaining life of the fixing belt, further based on a degree of edge abrasion that is the degree of abrasion determined based on a passing position of an edge of the sheet that passes through the fixing nip.

10. The image forming apparatus according to claim 9, wherein the hardware processor predicts a number of printed sheets with which the degree of planar abrasion is predicted to be a second threshold value, based on a highest degree from the respective degrees of planar abrasion of the plurality of regions stored in the hardware processor and the degree of edge abrasion that is the degree of abrasion determined based on the passing position of the edge of the sheet that passes through the fixing nip, and a cumulative number of sheets that have passed through the fixing nip.

11. The image forming apparatus according to claim 1, wherein the hardware processor adds, in a case where the degree of planar abrasion of a region is higher than the degree of planar abrasion of another region by a predetermined value or more from the respective degrees of planar abrasion of the plurality of regions stored in the hardware processor, toner to a portion that passes through the region, in a sheet on which a toner image of a new printing job is to be formed.

12. The image forming apparatus according to claim 1, wherein the hardware processor acquires a correction value of correcting the additional value from at least one of external equipment connected to the image forming apparatus and an operator that receives an operation of the image forming apparatus, and corrects the additional value with the correction value acquired by the hardware processor.

13. The image forming apparatus according to claim 1, wherein pressing force between the fixing belt and the presser is maximum on a downstream side from a central position of the fixing nip in a passing direction of the sheet.

14. The image forming apparatus according to claim 1, wherein the hardware processor transmits a parameter of determining the degree of planar abrasion of the fixing belt, to external equipment connected to the image forming apparatus.

15. The image forming apparatus according to claim 14, wherein the parameter includes, in a case where a region forming the fixing nip in the fixing belt is divided into a plurality of regions arranged in a direction orthogonal to a passing direction of the sheet, at least one of the respective degrees of planar abrasion of the plurality of regions, a size of the sheet, a type of the sheet, a temperature of the sheet, and the respective amounts of the toner adhering to portions of the sheet that pass through the plurality of regions.

16. The image forming apparatus according to claim 1, wherein the hardware processor determines the degree of planar abrasion of the fixing belt due to sliding between the sheet and a surface of the fixing belt.

17. The image forming apparatus according to claim 1, wherein the fixer comprises a pressure pad including a protrusion that presses the presser on a downstream side of the fixing nip in a conveyance direction of the sheet.

18. An image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the image forming apparatus comprising a hardware processor that calculates an amount of the toner adhering to the sheet that passes through the fixing nip, and determines a degree of planar abrasion of the fixing belt, based on the amount of the toner calculated by the hardware processor, wherein the hardware processor stores the degree of planar abrasion of the fixing belt, adds an additional value based on the amount of the toner calculated by the hardware processor, to the degree of planar abrasion stored in the hardware processor, corrects the additional value, based on at least one of a material and a temperature of the toner adhering to the sheet that passes through the fixing nip, and adds the additional value corrected by the hardware processor, to the degree of planar abrasion stored in the hardware processor.

19. A control method of an image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the control method comprising:

calculating an amount of the toner adhering to the sheet that passes through the fixing nip; and determining a degree of planar abrasion of the fixing belt, based on the amount of the toner calculated in the calculating, wherein the control method further comprises:

storing the degree of planar abrasion of the fixing belt, and adding an additional value based on the calculated amount of the toner, to the stored degree of planar abrasion, and wherein the control method further comprises:

dividing a region forming the fixing nip in the fixing belt, into a plurality of regions arranged in a direction orthogonal to a passing direction of the sheet, to calculate the respective amounts of the toner adhering to portions of the sheet that pass through the plurality of regions, storing the respective degrees of planar abrasion of the plurality of regions, and adding the calculated respective additional values of the plurality of regions, to the respective degrees of planar abrasion of the plurality of regions.

20. The control method according to claim 19, wherein the determining comprises determining the degree of planar abrasion of the fixing belt due to sliding between the sheet and a surface of the fixing belt.

21. The control method according to claim 19, wherein the fixer comprises a pressure pad including a protrusion that presses the presser on a downstream side of the fixing nip in a conveyance direction of the sheet.

22. A non-transitory recording medium storing a computer readable control program of an image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the computer readable control program causing a computer to perform:

calculating an amount of the toner adhering to the sheet that passes through the fixing nip; and determining a degree of planar abrasion of the fixing belt, based on the amount of the toner calculated in the calculating, wherein the computer readable control program further causes the computer to perform:

storing the degree of planar abrasion of the fixing belt, and adding an additional value based on the calculated amount of the toner, to the stored degree of planar abrasion, and wherein the computer readable control program further causes the computer to perform:

dividing a region forming the fixing nip in the fixing belt, into a plurality of regions arranged in a direction orthogonal to a passing direction of the sheet, to calculate the respective amounts of the toner adhering to portions of the sheet that pass through the plurality of regions, storing the respective degrees of planar abrasion of the plurality of regions, and adding the calculated respective additional values of the plurality of regions, to the respective degrees of planar abrasion of the plurality of regions.

23. The non-transitory recording medium according to claim 22, wherein the determining comprises determining the degree of planar abrasion of the fixing belt due to sliding between the sheet and a surface of the fixing belt.

24. The non-transitory recording medium according to claim 22, wherein the fixer comprises a pressure pad including a protrusion that presses the presser on a downstream side of the fixing nip in a conveyance direction of the sheet.

25. A control method of an image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the control method comprising:

calculating an amount of the toner adhering to the sheet that passes through the fixing nip; and determining a degree of planar abrasion of the fixing belt, based on the amount of the toner calculated in the calculating, wherein the control method further comprises:

storing the degree of planar abrasion of the fixing belt, adding an additional value based on the calculated amount of the toner, to the stored degree of planar abrasion, correcting the additional value, based on at least one of a material and a temperature of the toner adhering to the sheet that passes through the fixing nip, and adding the corrected additional value to the stored degree of planar.

26. A non-transitory recording medium storing a computer readable control program of an image forming apparatus including a fixer that fixes toner adhering to a sheet that passes through a fixing nip, the fixer including: an endless fixing belt that rotates; and a presser that presses the fixing belt to form the fixing nip between the fixing belt and the presser, the computer readable control program causing a computer to perform:

calculating an amount of the toner adhering to the sheet that passes through the fixing nip; and determining a degree of planar abrasion of the fixing belt, based on the amount of the toner calculated in the calculating, wherein the computer readable control program further causes the computer to perform:

storing the degree of planar abrasion of the fixing belt, adding an additional value based on the calculated amount of the toner, to the stored degree of planar abrasion, correcting the additional value, based on at least one of a material and a temperature of the toner adhering to the sheet that passes through the fixing nip, and adding the corrected additional value to the stored degree of planar.

* * * * *